United States Patent [19]

Hara et al.

[11] 4,245,018

[45] Jan. 13, 1981

[54] METHOD FOR STABILIZING ORGANIC SUBSTRATE MATERIALS INCLUDING PHOTOGRAPHIC DYE IMAGES TO LIGHT AND A COLOR DIFFUSION TRANSFER MATERIAL

[75] Inventors: Hiroshi Hara, Asaka; Kotaro Nakamura; Yoshiaki Suzuki, both of Minami-ashigara, all of Japan

[73] Assignee: Fuji Photo Film Co., Ltd., Minami-ashigara, Japan

[21] Appl. No.: 56,674

[22] Filed: Jul. 11, 1979

[30] Foreign Application Priority Data

Jul. 11, 1978 [JP] Japan ..... 53-8426

[51] Int. Cl.[3] ..... G03C 1/40; G03C 7/00; G03C 1/84; G03C 1/10

[52] U.S. Cl. ..... 430/14; 8/506; 8/447; 260/45.75 R; 260/45.75 C; 260/45.75 M; 260/45.75 N; 260/45.8 NZ; 106/287.18; 430/17; 430/216; 430/372; 430/512; 430/517; 430/551; 430/559

[58] Field of Search ..... 8/4, 74; 260/45.75 R, 260/45.75 N, 45.75 M, 45.75 C, 45.8 NZ; 106/287.18; 430/216, 372, 512, 517, 551, 17, 559, 114

[56] References Cited

U.S. PATENT DOCUMENTS

| | | | |
|---|---|---|---|
| 2,615,860 | 10/1952 | Burgess | 260/45.75 N |
| 3,361,710 | 1/1968 | Sparks | 260/45.75 N |
| 3,361,712 | 1/1968 | Cyba | 260/45.75 N |
| 4,050,938 | 9/1977 | Smith et al. | 96/84 R |

*Primary Examiner*—Richard L. Schilling
*Attorney, Agent, or Firm*—Sughrue, Rothwell, Mion, Zinn and Macpeak

[57] ABSTRACT

The light stability of organic substrate materials such as photographic dyes is improved by the copresence of at least one of the complexes shown by following formulae I, II, III, or IV

I

II

III

IV wherein M represents Cu, Co, Ni, Pd or Pt; $R^1$, $R^2$, $R^3$ and $R^4$ each represents a hydrogen atom, a halogen atom, a cyano group or an alkyl group, an aryl group, a cycloalkyl group or a heterocyclic group bonded directly or through a divalent connecting group to the carbon atom of a benzene ring; or $R^1$ and $R^2$; $R^2$ and $R^3$; or $R^3$ and $R^4$ combine to represent the non-metallic atoms necessary to complete a 6-membered ring; $R^5$ and $R^8$ each represents a hydrogen atom, an alkyl group, or an aryl group; $R^6$ represents a hydrogen atom, an alkyl group, an aryl group, or a hydroxyl group; $R^7$ represents an alkyl group or an aryl group; and Z represents the non-metallic atoms necessary to complete a 5-membered or 6-membered ring.

27 Claims, No Drawings

METHOD FOR STABILIZING ORGANIC SUBSTRATE MATERIALS INCLUDING PHOTOGRAPHIC DYE IMAGES TO LIGHT AND A COLOR DIFFUSION TRANSFER MATERIAL

BACKGROUND OF THE INVENTION

1. Field of the Invention

The present invention relates to stabilizing organic substrate materials and, more particularly, to stabilizing organic compounds and particularly photographic dye images to light.

2. Description of the Prior Art

In general, it is widely known that organic substrate materials, for example, organic dyes tend to fade or discolor by the action of light and in the fields of inks, textile dyeing color photography, etc., means of improving the light fastness of organic dyes, preventing fading or discoloring of such organic dyes, etc., have been investigated. Many methods for reducing the occurence of fading or discoloring or increasing the light fastness of these organic substrate materials have been reported. For example, U.S. Pat. No. 3,432,300 discloses that the resistance or stabilization of organic compounds such as indophenol dyes, indoaniline dyes, azo dyes, and azomethine dyes to visible light and ultraviolet rays is improved by mixing them with a phenol type compound having fused heterocyclic ring.

Generally, in the field of silver halide photographic materials, various methods are known for improving the stability of color images, that is, the images of dyes such as azomethine dyes or indoaniline dyes formed by the reaction of the oxidation product of an aromatic primary amine color developing agent and couplers as described in C. E. K. Mees and T. H. James; *The Theory of the Photographic Process;* Chapter 17, published in 1967 by Macmillan Co. For example, there are the hydroquinone derivatives described in U.S. Pat. Nos. 2,360,290; 2,418,613; 2,675,314; 2,701,197; 2,704,713; 2,728,659; 2,732,300; 2,735,765; 2,710,801; and 2,816,028; and U.K. Pat. No. 1,363,921, the gallic acid derivatives described in U.S. Pat. Nos. 3,457,079 and 3,069,262 and Japanese Patent Publication No. 13,496/'68, the p-alkoxyphenols described in U.S. Pat. Nos. 2,735,765 and 3,698,909, and the derivatives such as chroman and cumarin described in U.S. Pat. Nos. 3,432,300; 3,573,050; 3,574,627; 3,764,337; 3,574,626; 3,698,909 and 4,015,990. However, these compounds have an effect as a fading preventing agent or discoloring preventing agent for color images but the effect is insufficient.

Also, a method for improving the stability of organic compounds to light by using an azomethine quenching compound of which the absorption maximum is at a longer wavelength than the absorption maximum of the substrate material is described in U.K. Pat. No. 1,451,000 or U.S. Pat. No. 4,050,938 to Smith Jr. et al. However, since the azomethine quenching compound itself has deep color, the use of such a compound is disadvantageous in the point that it influences greatly on the color hue of the base material. In addition, it has also be found by the inventors that such as quenching compound adversely affects photographic speed, i.e., causes serious desensitization.

Also, the use of metal complexes for the prevention of light deterioration of polymers is described by J. P. Guillory and R. S. Becker in *Journal of Polymer Science,* Polym. Chem. Ed., 12, 993(1974) and By R. P. R. Ranaweera and G. Scott in *Journal of Polymer Science,* Polym. Lett., Ed., 13, 71(1975) and further a method of stabilizing dyes by metal complexes is described in Japanese patent Application (OPI) No. 87,649/'75 and "Research Disclosure", 15162(1976). However, since the fading prevention effect itself of these complexes is not so high and the solubility thereof in organic solvents is not high, it is difficult to add the complexes in an amount sufficient for obtaining the desired fading prevention effect. Furthermore, these complexes themselves are greatly colored and hence they have such difficulty that if a large amount of the complex is used, it gives bad influences on the color hue and the purity of the organic materials, in particular, dyes.

SUMMARY OF THE INVENTION

An object of this invention is to provide a method of improving the stability of organic substrate materials to light.

Another object of this invention is to provide a method of improving the stability of organic substrate materials and, in particular, dyes to light without degrading their hue and purity.

Still another object of this invention is to provide a method of improving the stability of organic substrate materials to light using a particular stabilizer having high solubility in organic solvents and high miscibility with the organic substrate materials.

A further object of this invention is to provide a method of improving the stability of dyes forming color photographic images to light.

Another object of this invention is to provide a method of improving the light fastness of dyes formed by the reaction of an oxidized aromatic primary amino color developing agent and color couplers.

A further object of the present invention is to provide a diffusion transfer color photographic material incorporating a particular stabilizer in which the transferred dye images posses improved light fastness.

Still a further object of the present invention is to improve the light fastness of colored polymers such as encountered in agricultural vinyl sheets, umbrellas, tents, etc.

Other objects of this invention will also become clear from the following description of the invention.

The above-described and other objects of this invention can be attained by the coexistence of at least one of the complexes shown by following formulae I, II, III, or IV with the organic substrate materials having an absorption maximum in a wave length region of from about 300 n. m. to about 800 n. m.;

I

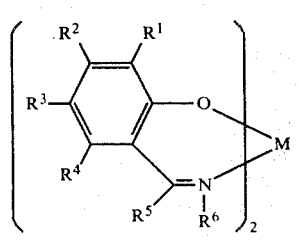

-continued

II

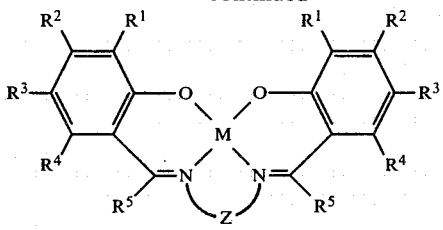

III

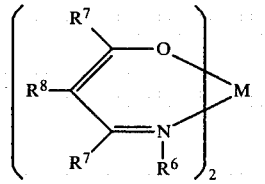

IV

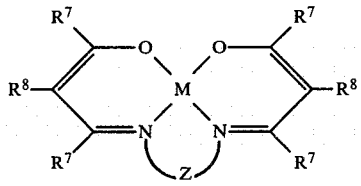

wherein M represents Cu, Co, Ni, Pd or Pt; $R^1$, $R^2$, $R^3$ and $R^4$ each represents a hydrogen atom, a halogen atom, a cyano group or an alkyl group, an aryl group, a cycloalkyl group, or a heterocyclic group bonded directly or through a divalent connecting group to the carbon atom of a benzene ring; or $R^1$ and $R^2$; $R^2$ and $R^3$; or $R^3$ and $R^4$ combine to represent the non-metallic atoms necessary to complete a 6-membered ring; $R^5$ and $R^8$ each represent a hydrogen atom, an alkyl group or an aryl group; $R^6$ represents hydrogen atom, an alkyl group, an aryl group, or a hydroxyl group; $R^7$ represents an alkyl group or an aryl group; and Z represents the non-metallic atoms necessary to complete a 5-membered or 6-membered ring.

DESCRIPTION OF THE INVENTION

The terms "in the presence of" or "coexistant with" as used in the specification refer not only to the coexistence of the substrate material and the compounds of formulae (I)–(IV) in the same solution, dispersion, emulsion or layer, but also to the existence of the organic substrate material and the complex in, for example, adjacent layers of a multilayer photographic material. As long as the complex is associated with the organic substrate material in some way that it can improve the light fastness of the organic substrate material, it is used "in the presence of" or "coexists with" the substrate for purposes of the present invention. In particular, the terms include the embodiments of the invention discussed later in which an organic substrate material such as a photographic dye or a photographic dye image providing material is coated in one layer with the complexes used in the present invention or the substrate material and complex are coated in separate layers of a photographic material such that upon migration or diffusion the two materials interact to improve the light fastness of the substrate material.

As described above, the invention provides a method of improving the light fastness or light resistance of organic substrate materials (organic materials). The term "organic substrate material" or "substrate material" used in the specification includes materials which appear colored or colorless the human eye under sun light and thus includes not only materials having a absorption maximum in the visible region but also optical whitening agents or materials having an absorption maximum in the infrared region. Thus, in this invention, the organic substrate materials include organic materials having an absorption maximum in a region from about 300 nm in ultraviolet region to about 800 nm in infrared region.

These organic substrate materials occur particularly in photographic materials, e.g., color films, prints, diffusion transfer units, etc., in colored polymers useful as agricultural vinyl cover sheets, umbrellas, tents, etc.; fluorescent whitening agents; and dyed textiles, etc.; and this invention is directed to improving the light fastness of these materials in each of these fields.

The term "dye" or "coloring matter" used in this invention are organic substrate materials which appear colored to the human eye under sun light.

The term "light" used in this invention refers to electromagnetic radiation of wavelengths shorter than about 800 nm and includes ultraviolet rays of wavelength shorter than about 400 nm, visible radiation of from about 400 nm to about 700 nm, and infrared rays of from about 700 nm to about 800 nm.

Now, the general formulae I, II, III and IV showing the complexes used in this invention will be explained in detail.

The halogen atoms represented by $R^1$, $R^2$, $R^3$ and $R^4$ in the formulae include a fluorine atom, a chlorine atom, a bromine atom, and an iodine atom.

The alkyl group represented by $R^1$, $R^2$, $R^3$ and $R^4$ preferably has 1 to 19 carbon atoms and may be a straight chain or branched alkyl group which may be substituted or unsubstituted.

The aryl group represented by $R^1$, $R^2$, $R^3$ and $R^4$ is preferably an aryl group having 6 to 14 carbon atoms which may be monocyclic or bicyclic and unsubstituted/or substituted.

The heterocyclic group represented by $R^1$, $R^2$, $R^3$ and $R^4$ is preferably a 5-membered or a 6-membered heterocyclic ring which may be substituted/or unsubstituted.

The cycloalkyl group represented by $R^1$, $R^2$, $R^3$ and $R^4$ is preferably a cyclohexyl or a cyclopentyl group which may be an substituted/or unsubstituted.

The 6-membered ring formed by the combination of $R^1$ and $R^2$; $R^2$ amd $R^3$; or $R^3$ and $R^4$ is preferably a benzene ring which may be unsubstituted/or substituted and which may be condensed with another ring.

Examples of the straight chain or branched alkyl group represented by $R^1$, $R^2$, $R^3$ and $R^4$ are a methyl group, an ethyl group, a propyl group, a butyl group, a hexyl group, an octyl group, a decyl group, a dodecyl group, a tetradecyl group, a hexadecyl group, an octadecyl group, etc.

Examples of the aryl group represented by $R^1$, $R^2$, $R^3$ and $R^4$ are a phenyl group and a naphthyl group.

The heterocyclic group represented by $R^1$, $R^2$, $R^3$ and $R^4$ is preferably a 5-membered or 6-membered heterocyclic group having at least one nitrogen atom, oxygen atom or sulfur atom in the ring as the hetero atom. Examples of the heterocyclic group are a furyl group, a hydrofuryl group, a thienyl group, a pyrrolyl group, a pyrrolidyl group, a pyridyl group, an imidazolyl group, a pyrazolyl group, a quinolyl group, an indolyl group, an oxazolyl group, a thiazolyl group, etc.

Examples of the cycloalkyl group represented by $R^1$, $R^2$, $R^3$ and $R^4$ are a cyclopentyl group, a cylohexyl group, etc.

Examples of the 6-membered ring formed by the combination of $R^1$ and $R^2$; $R^2$ and $R^3$; or $R^3$ and $R^4$ are carbocyclic rings such as a benzene ring, a naphthalene ring, an isobenzothiophene ring, an isobenzofuran ring, an isoindoline ring, etc.

The alkyl group, cycloalkyl group, aryl group or heterocyclic group represented by aforesaid $R^1$, $R^2$, $R^3$ and $R^4$ may be bonded to the carbon atom of a benzene ring directly or through a divalent connecting group such as an oxy group (—O—), a thio group (—S—), an amino group, an oxycarbonyl group, a carbonyl group, a carbamoyl group, a sulfamoyl group, a carbonylamino group, a sulfonyl group or a carbonyloxy group.

Examples of the group formed when the alkyl group represented by $R^1$, $R^2$, $R^3$ and $R^4$ is bonded to the carbon atom of a benzene ring via one of the above-described divalent connecting groups are an alkoxy group (e.g., methoxy group, ethoxy group, butoxy group, propoxy group, n-decyloxy group, n-dodecyloxy group, n-hexadecyloxy group, etc.), an alkoxycarbonyl group (e.g., methoxycarbonyl group, ethoxycarbonyl group, butoxycarbonyl group, n-decyloxycarbonyl group, n-hexadecyloxycarbonyl group, etc.,), an acyl group (e.g., acetyl group, valeryl group, stearoyl group, benzoyl group, toluoyl group, etc.,), an acyloxy group (e.g., acetoxy group, hexadecylcarbonyloxy group, etc.,), an alkylamino group (e.g., n-butylamino group, N,N-diethylamino group, N,N-dodecylamino group, etc.,), an alkylcarbamoyl group (e.g., butylcarbamoyl group, N,N-diethylcarbamoyl group, n-dodecylcarbamoyl group, etc.,), an alkylsulfamoyl group (e.g., butylsulfamoyl group, N,N-diethylsulfamoyl group, n-dodecylsulfamoyl group, etc.,), a sulfonylamino group (e.g., methylsulfonylamino group, butylsulfonylamino group, etc.,), a sulfonyl group (e.g., mesyl group, ethanesulfonyl group, etc.), and an acylamino group (e.g., acetylamino group, valerylamino group, palmitoylamino group, benzoylamino group, toluoylamino group, etc.,).

Examples of the group formed when a cycloalkyl group represented by $R^1$, $R^2$, $R^3$ and $R^4$ is bonded to the carbon atom of the ring of the compound of this invention via one of the aforesaid divalent connecting groups are a cyclohexyloxy group, a cyclohexylcarbonyl group, a cyclohexyloxycarbonyl group, a cyclohexylamino group, etc.

Examples of the group formed when an aryl group represented by $R^1$, $R^2$, $R^3$ and $R^4$ is bonded to the carbon atom of the ring of the compound of this invention via one of the aforesaid divalent connecting groups are an aryloxy group (e.g., phenoxy group, naphthoxy group, etc.,), an aryloxycarbonyl group (e.g., phenoxycarbonyl group, naphthoxycarbonyl group, etc.,), an acyl group (e.g., benzoyl group, naphthoyl group, etc.,), an anilino group (e.g., phenylamino group, N-methylanilino group, N-acetylanilino group, etc.,), an acyloxy group (e.g., benzoyloxy group, toluoyloxy group, etc.,), an arylcarbamoyl group (e.g., phenylcarbamoyl group, etc.,), an arylsulfamoyl group (e.g., phenylsulfamoyl group, etc.,), an arylsulfonylamino group (e.g., phenylsulfonylamino group, p-tolylsulfonylamino group, etc.,), an arylsulfonyl group (e.g., benzenesulfonyl group, tosyl group, etc.,), and an acylamino group (e.g., benzoylamino group, etc.,).

The alkyl group, aryl group, heterocyclic group, and cycloalkyl group represented by $R^1$, $R^2$, $R^3$ and $R^4$ or the 6-membered ring formed by the combination of $R^1$ and $R^2$; $R^2$ and $R^3$; or $R^3$ and $R^4$ may be substituted up to tri-substitution by a halogen atom (e.g., a chlorine atom, a bromine atom, a fluorine atom, etc.,), a cyano group, a straight chain or branched C1–20 alkyl group (e.g., methyl group, ethyl group, propyl group, butyl group, hexyl group, octyl group, decyl group, dodecyl group, tetradecyl group, hexadecyl group, heptadecyl group, octadecyl group, methoxyethoxyethyl group etc.,), a C6–14 aryl group (e.g., phenyl group, tolyl group, naphthyl group, chlorophenyl group, methoxyphenyl group, acetylphenyl group, etc.,), a C1–20 alkoxy group (e.g., methoxy group, ethoxy group, butoxy group, propoxy group, methoxyethoxy group, etc.,), a C6–14 aryloxy group (e.g., phenoxy group, tolyloxy group, naphthoxy group, methoxyphenoxy group, etc.,), a C2–20 alkoxycarbonyl group (e.g., methoxycarbonyl group, butoxycarbonyl group, phenoxymethoxycarbonyl group, etc.,), a C7–15 aryloxycarbonyl group (e.g., phenoxycarbonyl group, tolyloxycarbonyl group, methoxyphenoxycarbonyl group, etc.,), a C2–20 acyl group (e.g., formyl group, acetyl group, valeryl group, stearoyl group, benzoyl group, toluoyl group, naphthoyl group, p-methoxybenzoyl group, etc.,), a C2–20 acyloxy group (e.g., acetoxy group, benzyloxy group, etc.,), a C2–20 acylamino group (e.g., acetamido group, benzamido group, methoxyacetamido group, etc.,), an anilino group (e.g., phenylamino group, N-methylanilino group, N-phenylanilino group, N-acetylanilino group, etc.,), a C1–20 alkylamino group (e.g., n-butylamino group, N,N-diethylamino group, 4-methoxy-n-butylamino group, etc.,), a carbamoyl group (e.g., an alkyl carbamoyl group such as n-butylcarbamoyl group, N,N-diethylcarbamoyl group, etc.), a sulfamoyl group (e.g., a n-butylsulfamoyl group, N,N-diethylsulfamoyl group, n-dodecylsulfamoyl group, N-(4-methoxy-n-butyl)sulfamoyl group, etc.,), a sulfonylamino group (e.g., methylsulfonylamino group, phenylsulfonylamino group, methoxymethylsulfonylamino group, etc.,), or a sulfonyl group (e.g., mesyl group, a tosyl group, a methoxymethanesulfonyl group, etc.,).

The alkyl group represented by $R^5$, $R^6$, $R^7$ and $R^8$ includes both unsubstituted alkyl groups and a substituted alkyl groups and may be a straight chain or branched alkyl group. The substitution may be as defined for $R^1$–$R^4$ above. The alkyl group has preferably 1 to 20 carbon atoms excluding the carbon atoms of any substituent. Examples of the alkyl group are methyl group, ethyl group, propyl group, butyl group, hexyl group, octyl group, decyl group, dodecyl group, tetradecyl group, hexadecyl group, heptadecyl group, octadecyl group, etc.

The aryl group represented by $R^5$, $R^6$, $R^7$ and $R^8$ includes both unsubstituted aryl groups and substituted aryl groups and has preferably 6 to 14 carbon atoms excluding the carbon atoms of any substituent and is monocyclic or bicyclic. The substitation may be as defined for $R^1$–$R^4$ above. Examples of the aryl group are phenyl group, tolyl group, naphthyl group, etc.

The non-metallic atomic group Z forming a 5-membered ring or 6-membered ring includes the non-metallic atomic groups represented by the following formulae (a), (b), (c), (d) or (e);

(a)

(b)

(c)

(d)

(e)

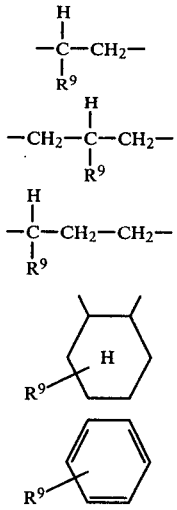

wherein $R^9$ represents a hydrogen atom or an alkyl group.

The alkyl group represented by $R^9$ includes both unsubstituted alkyl groups and a substituted alkyl groups, the alkyl group has preferably 1 to 20 carbon atoms excluding the carbon atoms of any substituent and the alkyl group may be a straight chain or branched alkyl group. $R^9$ may be substituted as defined for $R^1$–$R^4$ above. Representative examples of the alkyl group include those examples illustrated for $R^1$, $R^2$, $R^3$ and $R^4$.

Preferred complexes for use in this invention are:

(i) complexes of the formula I where $R^5$ is hydrogen and $R^6$ is hydrogen or hydroxy;

(ii) complexes of the formula IIa;

IIa

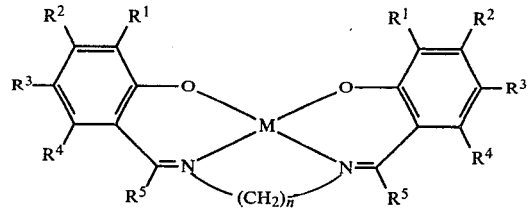

wherein $R^1$, $R^2$, $R^3$ and $R^4$ each represents a hydrogen atom, a halogen atom, a cyano group or an alkyl group, an aryl group, a cycloalkyl group, or a heterocyclic group bonded directly or through a divalent group to the carbon atom of a benzene ring; or $R^1$ and $R^2$; $R^2$ and $R^3$; or $R^3$ and $R^5$ represent a non-metallic atomic group necessary for forming a 6-membered ring by combining with each other; $R^5$ represents a hydrogen atom, an alkyl group or an aryl group; M represents Cu, Co, Ni, Pd or Pt; and n is 2 or 3;

(iii) complexes of the formula III where $R^6$ is hydrogen or hydroxy; and (iv) complexes of the formula IV where Z is an alkylene bridge such as an ethylene or a trimethylene bridge.

The particularly preferred complexes used in this invention are (i) and (ii) above. Furthermore, the complexes of (i) and (ii) above where at least one of the groups represented by $R^1$, $R^2$, $R^3$ and $R^4$ is an alkyl group or an alkoxy group are more preferred. Also, the preferred complexes of (i) and (ii) wherein the sum of the carbon atoms of the group represented by $R^1$, $R^2$, $R^3$, $R^4$, $R^5$, $R^6$ or $R^7$ is at least 4 are preferably used in this invention.

In terms of the cation M, Ni is most preferred while the others are almost equivalent with possibly a slight preference for Cu>Co>Pd>Pt.

Complexes of the above-described formulae I, II, III, and IV effective for the practice of this invention are illustrated below as structural formulae although the complexes used in this invention are not limited to these.

Compounds

I-1

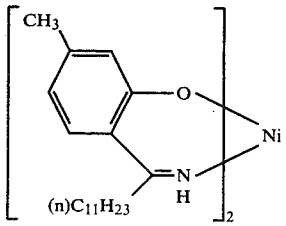

I-2

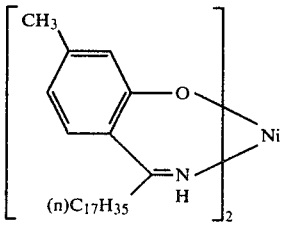

-continued
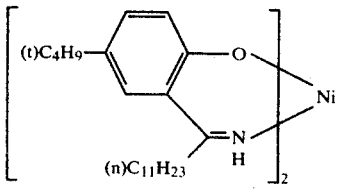
I-3
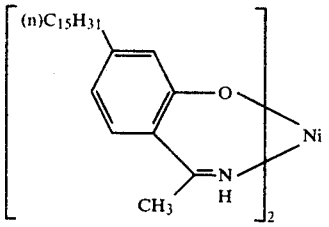
I-4
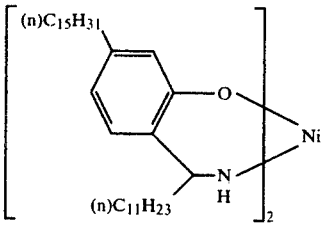
I-5
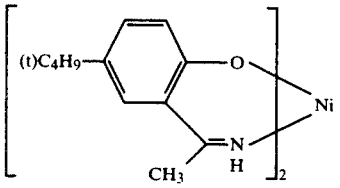
I-6
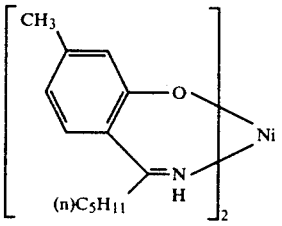
I-7
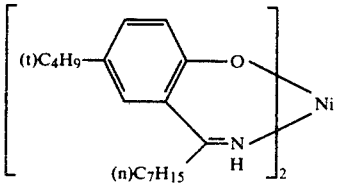
I-8
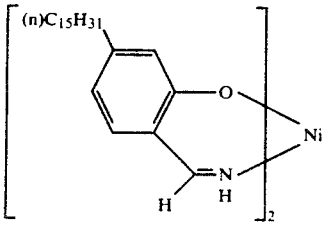
I-9

-continued
I-10
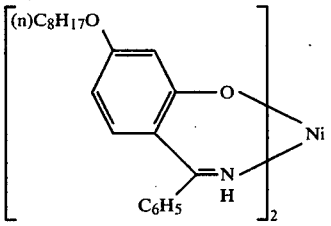
I-11
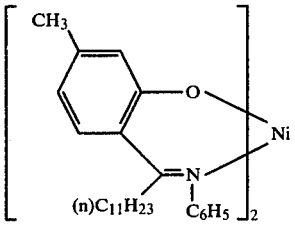
I-12
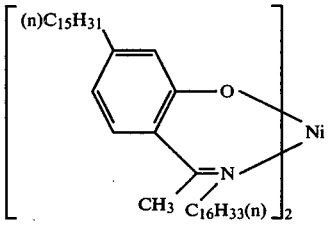
I-13
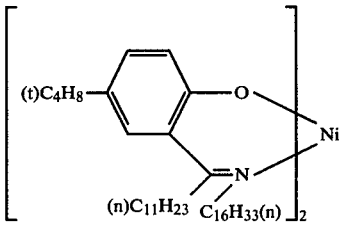
I-14
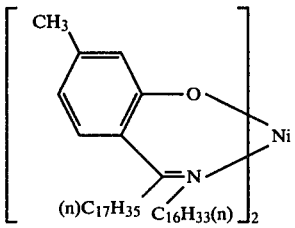
I-15
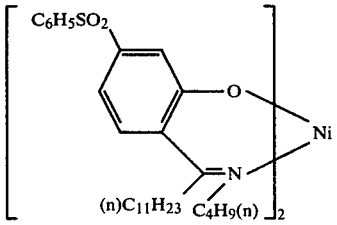
I-16
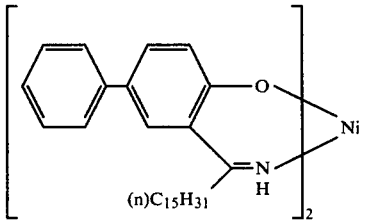

-continued
I-17
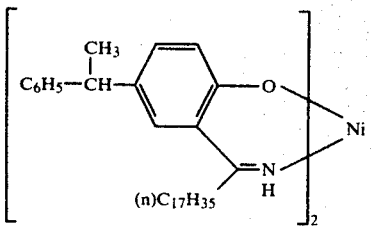
I-18
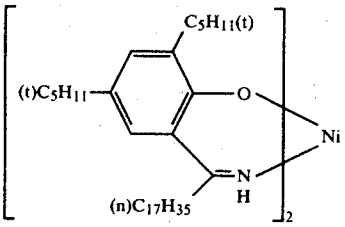
I-19
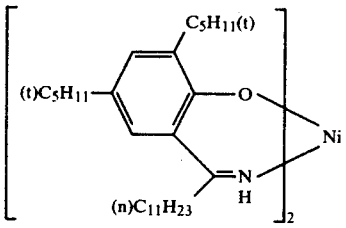
I-20
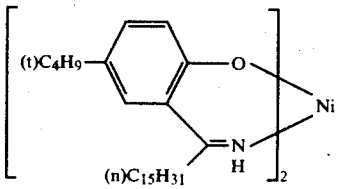
I-21
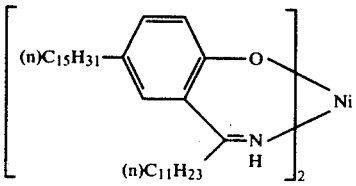
I-22
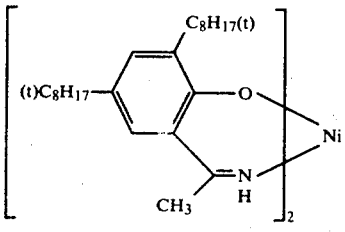
I-23
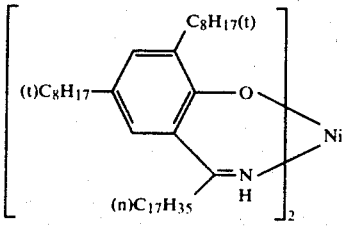

-continued
I-24
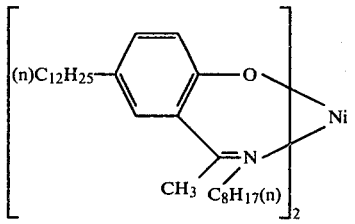
I-25
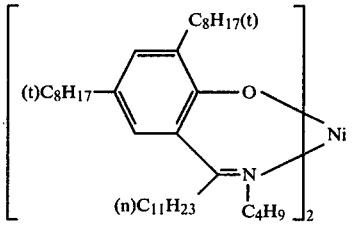
I-26
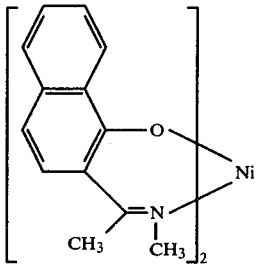
I-27
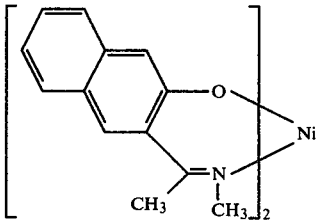
I-28
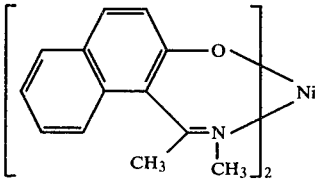
I-29
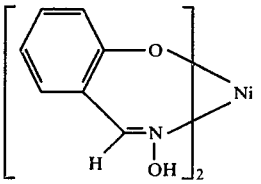
I-30
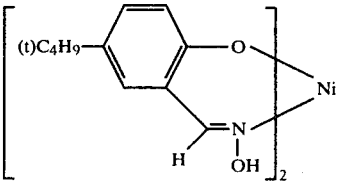

-continued
I-31
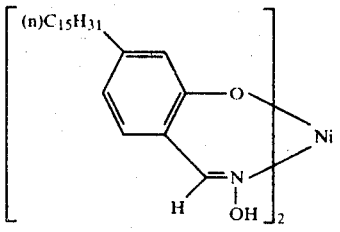
I-32
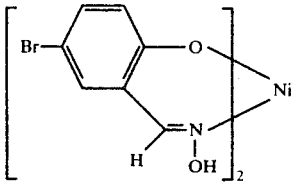
I-33
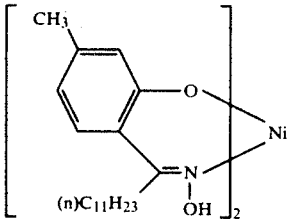
I-34
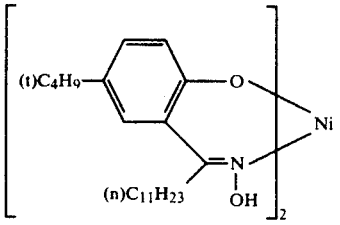
I-35
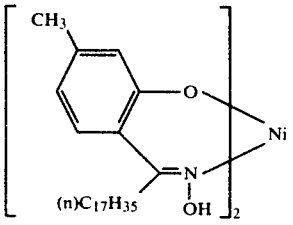
I-36
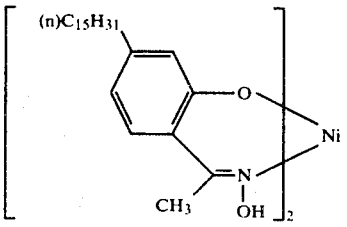
I-37
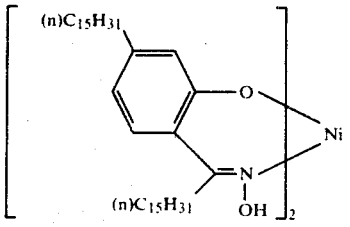

-continued
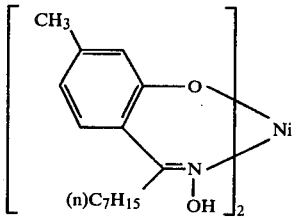
I-38
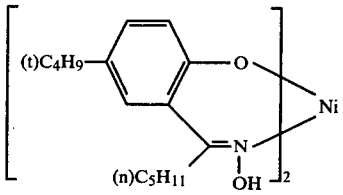
I-39
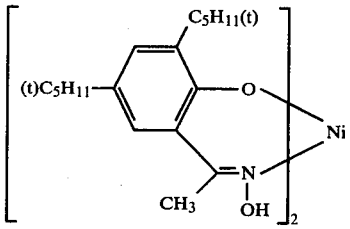
I-40
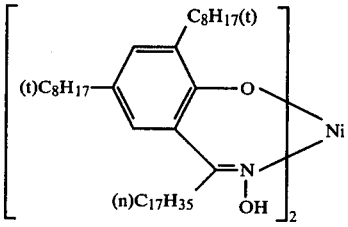
I-41
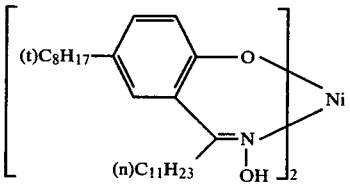
I-42
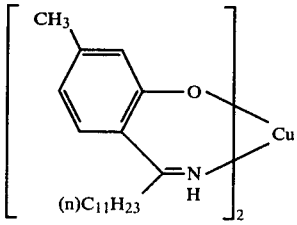
I-43
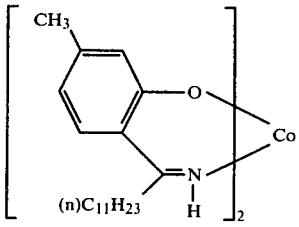
I-44

-continued
I-45
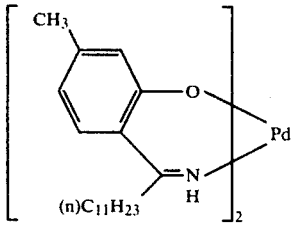
I-46
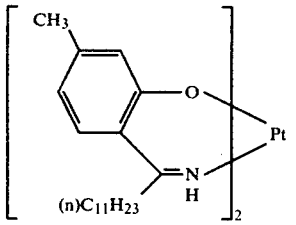
I-47
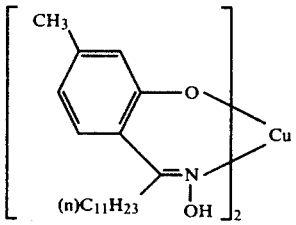
I-48
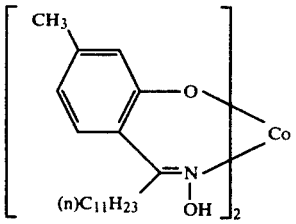
I-49
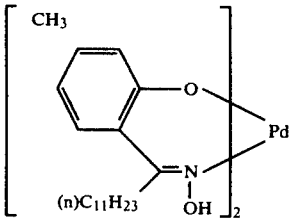
I-50
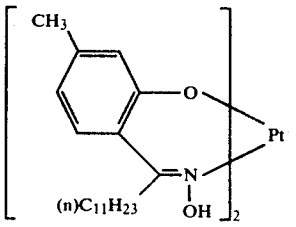
I-51
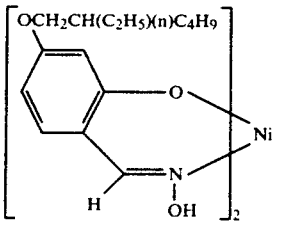

-continued
I-52
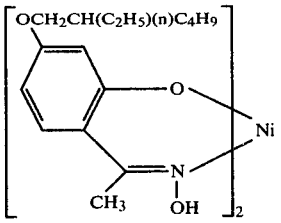
I-53
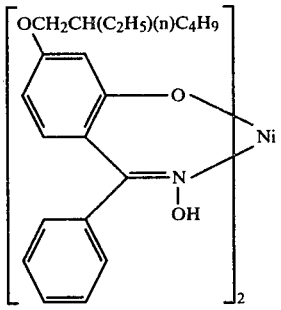
I-54
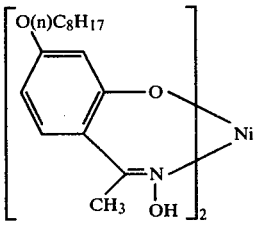
I-55
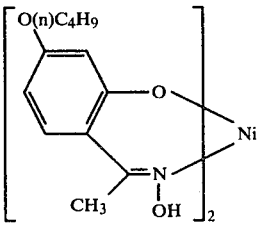
I-56
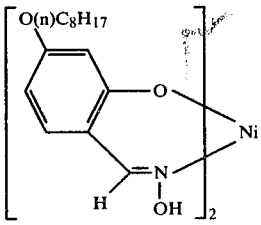
I-57
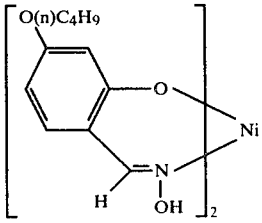

-continued
I-58
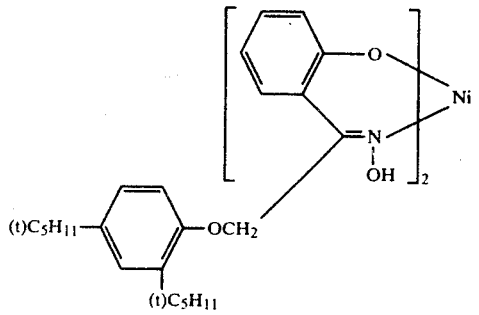
I-59
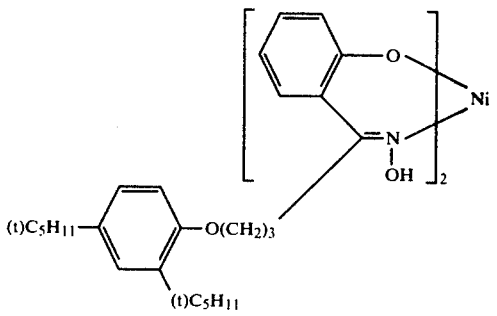
I-60
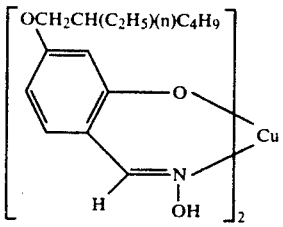
I-61
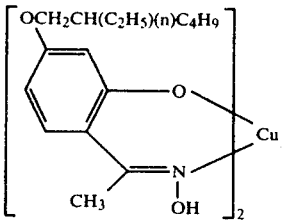
I-62
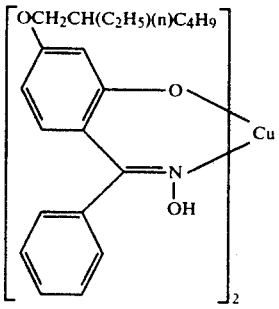
I-63
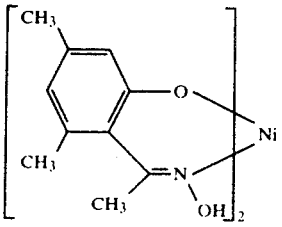

-continued
I-64
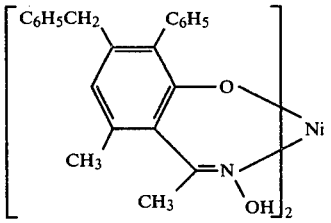
I-65
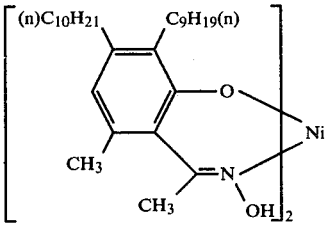
I-66
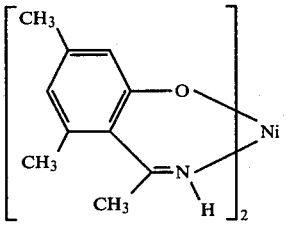
II-1
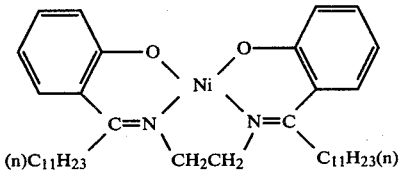
II-2
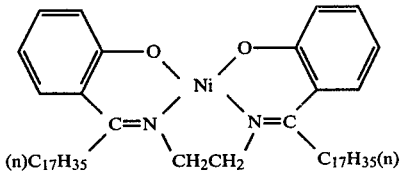
II-3
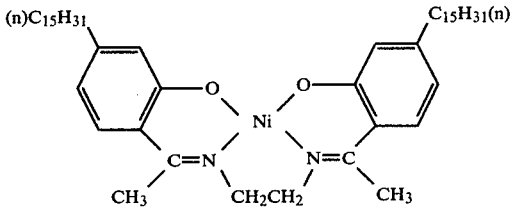
II-4
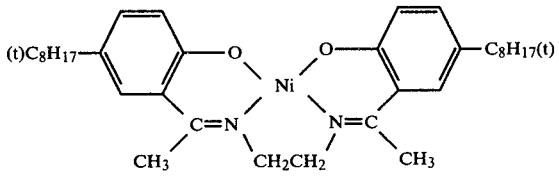
II-5
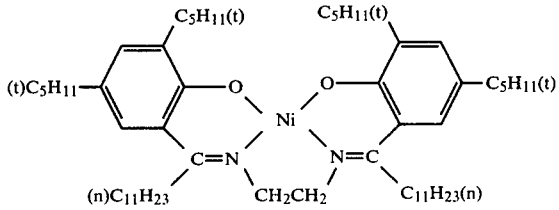

-continued
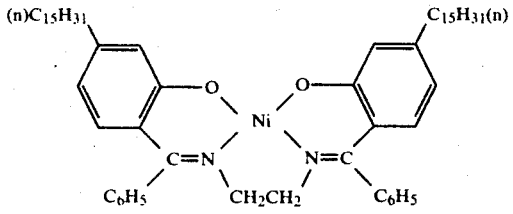
II-6
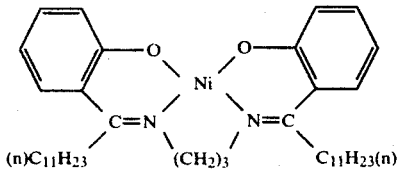
II-7
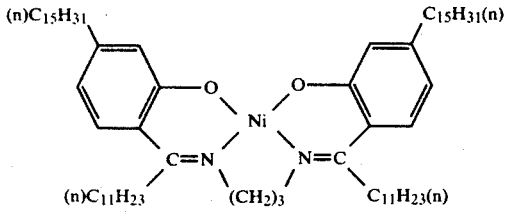
II-8
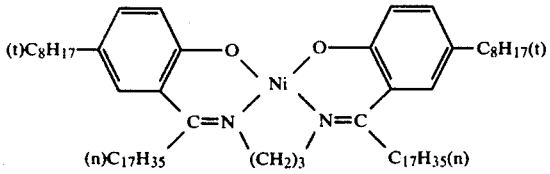
II-9
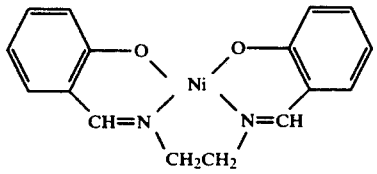
II-10
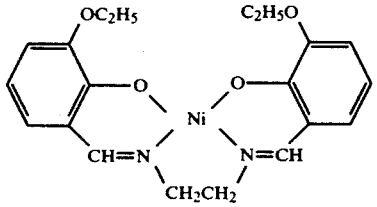
II-11
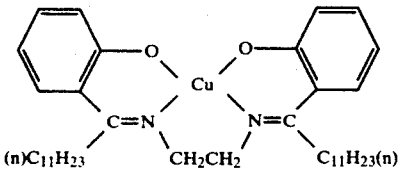
II-12
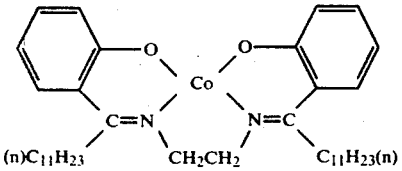
II-13
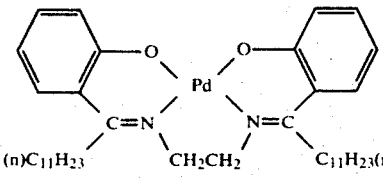
II-14

-continued
II-15
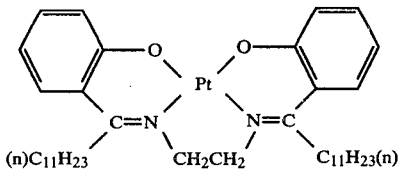
II-16
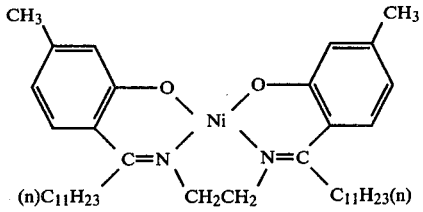
II-17
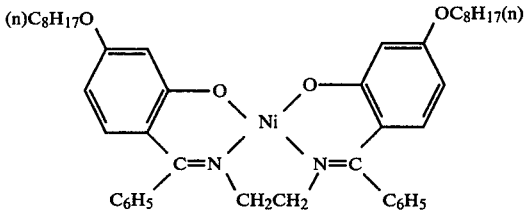
II-18
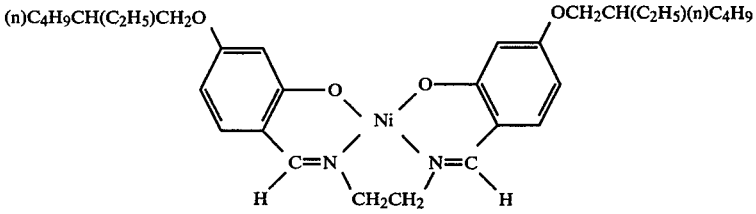
III-1
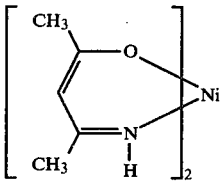
III-2
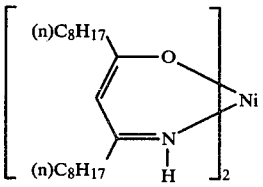
III-3
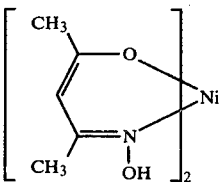
III-4
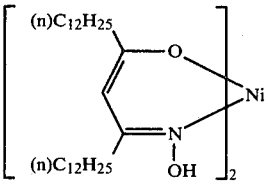

-continued
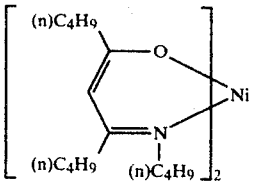
III-5
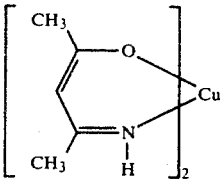
III-6
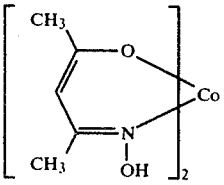
III-7
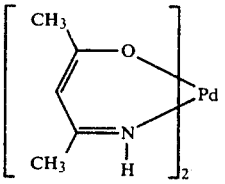
III-8
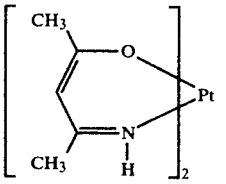
III-9
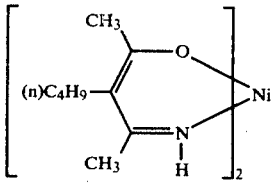
III-10
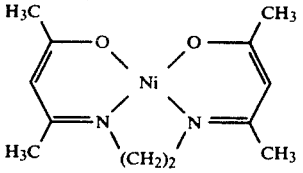
IV-1
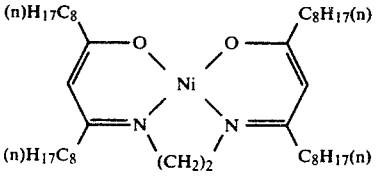
IV-2
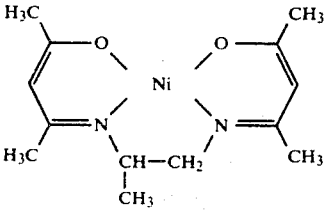
IV-3

-continued

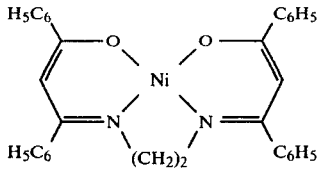

IV-4

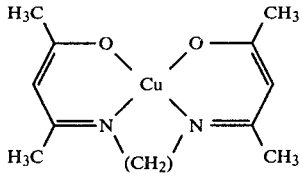

IV-5

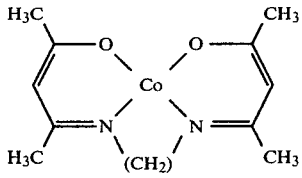

IV-6

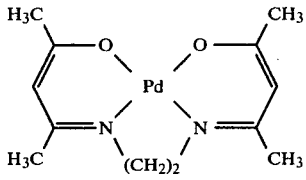

IV-7

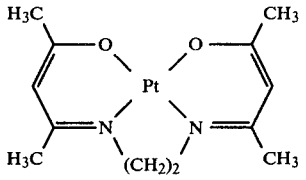

IV-8

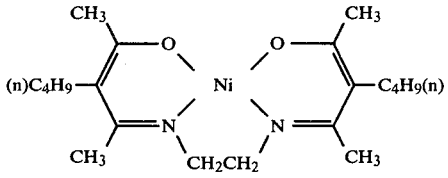

IV-9

General synthesis methods of the above-described complexes are described in G. W. Everett and A. Chakravorty; "Metal Complexes of Schiff Bases and $\beta$-Ketoamines", "Inorganic Chemistry", 783(1966), L Sacconi; "Coord. Chem. Ref.", 1, 126(1966), etc. and summarized below.

(1) Synthesis of complexes of the formula (I) or (III) wherein $R^6$ is hydrogen:

To a solution of 0.5 mol of alkali hydroxides such as sodium hydroxide in ca. 130 ml of low boiling point alcohols such as methanol, 0.5 mol of 2-acylphenol is added to completely dissolve therein. The resulting solution is gradually added to an aqueous solution of 0.05 mol of a metal halide such as nickel chloride. The precipitate formed is separated by filtration. To 5 g of the so obtained compound is added 100 ml of concentrated $NH_3$ water. The mixture is stirred for 3 days at ambient temperature. Red-brown precipitates are obtained. After isolation, the product is purified in a conventional manner.

(2) Synthesis of complexes of the formula (I) or (III) wherein $R^6$ is hydroxy:

A solution of 1 mol of oximes (obtained by reacting a 2-acylphenol with hydroxylamine sulfate in a conventional manner) in alcohols such as ethanol is refluxed. To the solution is added dropwise an alcohol solution of 0.5 mol of a metal halide such as nickel chloride. After completion of the addition, the solvent is evaporated off. The resulting residue is purified in a conventional manner.

(3) Synthesis of Complexes of the formula (II) or (IV)

A mixture of the product obtained by the reaction of acylphenols and ethylene dioxide with acetyl nickel is refluxed in a lower alcohol. The resulting precipitates are purified in a conventional manner.

The details of these synthetic procedures are described in the references cited above.

Examples of the synthesis of the complexes used in this invention are illustrated below.

SYNTHESIS EXAMPLE 1

Synthesis of Compound I-1

In 130 ml of methanol is dissolved 2 g of sodium hydroxide. Then 14.5 g of 2-lauroyl-5-methylphenol is added to the methanol solution and dissolved therein completely. The solution obtained is added gradually to an aqueous solution formed by dissolving 12 g of nickel chloride hexahydrate in 100 ml water and the light green precipitates formed were recovered by filtration, washed with water and air-dried. The precipitates have the following structure;

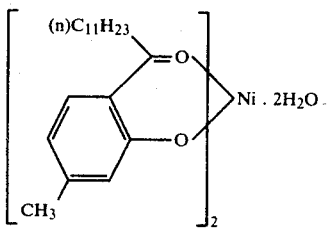

To 5 g of the dry nickel complex thus obtained is added 100 ml of concentrated aqueous ammonia and the mixture is stirred for 72 hours at room temperature, whereby red-brown precipitates form. The precipitates are recovered by filtration, washed with water, air-dried and recrystallized from benzene to provide 3 g of the red crystals of the desired compound.

SYNTHESIS EXAMPLE 2

Synthesis of Compound I-33

In 26 ml of ethanol is dissolved 3.06 g of 2-hydroxy-4-methylphenylundecylketooxine obtained by the reaction of 2-lauroyl-5-methylphenol and hydroxylamine sulfate and the solution is refluxed. To the solution is added dropwise 7 ml of a solution of 1.10 g of nickel chloride hexahydrate gradually. After the dropwise addition is over, the solution is concentrated to remove the solvent and the dark green solid material thus obtained is recrystallized from benzene. Thus, 2.4 g of the fine crystals of Compound I-33 are obtained.

As will be apparent from the extensive discussion and examples of the organic substrate material which follows, the present invention is effective with a wide variety of organic materials.

The organic substrate materials in this invention include all dyes belonging to the following classes based on dyeing property, i.e., water-soluble dyes such as basic dyes, acid dyes, direct dyes, soluble vat dyes, mordant dyes, etc.; water-insoluble dyes such as sulfur dyes, vat dyes, oil colors, disperse dyes, azoic dyes, acid dyes, etc.; and reactive dyes. These organic substrate materials include not only the dyes which are seen as colored materials under sunlight but also colorless or light yellow optical whitening dyes.

Of these dyes, the dyes preferably used in conjunction with this invention are quinoneimine dyes (e.g., azine dyes, oxazine dyes, thiazine dyes, etc.), methine and polymethine dyes (e.g., cyanine dyes, azomethine dyes, etc.), azo dyes, anthraquinone dyes, indoamine dyes, indophenol dyes, indigoid dyes, carbonium dyes, formazan dyes, etc., classified by chemical structure.

The organic substrate materials in this invention also include image-forming dyes used in the field of photography, for example, the dyes formed from color couplers, DRR compounds, DDR couplers, amidrazone compounds, dye developers, etc., and dyes for the silver dye bleach process.

Preferred organic substrate materials in this invention are anthraquinone dyes, quinoneimine dyes, azo dyes, methine polymethine dyes, indoamine dyes, indophenol dyes, and formazan dyes.

Furthermore, examples of the most preferred dyes used at the practice of this invention are methine dyes, polymethine dyes, indoamine dyes and indophenol dyes also include compounds having the following moiety:

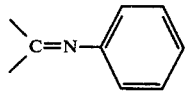

wherein the phenyl group may be substituted by an alkyl group, an alkoxy group, a halogen atom, or an amino group.

The dye-forming couplers suitably used in this invention include yellow dye-forming couplers, magenta dye-forming couplers and cyan dye-forming couplers. These couplers may be so-called 4-equivalent couplers or 2-equivalent couplers as described in U.S. Pat. Nos. 3,277,155 and 3,458,315.

The yellow dye-forming couplers generally contain at least one methylene group activated by a carbonyl group (for example, open chain type ketomethylene groups) and include β-diketones and β-ketoacylamides such as, for example, benzylacetanilide and α-pivalylacetanilide. Examples of the suitable yellow couplers used in this invention are described in U.S. Pat. Nos. 2,428,054, 4,026,706, 2,499,966, 2,453,661, 2,778,658, 2,908,573, 3,227,550, 3,253,924, 3,277,155 and 3,384,657 and British Pat. No. 503,752.

As the magenta dye-forming couplers used in this invention, there are, for example, 5-pyrazolone type couplers. The couplers of this type are described in, for example, U.S. Pat. Nos. 2,600,788, 2,725,292, 2,908,573, 3,006,759, 3,062,653, 3,152,896, 3,227,550, 3,252,924, 4,026,706 and 3,311,476.

Other magenta dye-forming couplers used in this invention are the indazolones of the type described in Vittum and Weissberger, *Journal of Photographic Science,* Vol. 6, page 158 et seq. (1958) and practical examples of such magenta dye-forming couplers are pyrazolinobenzimidazole as described in U.S. Pat. No. 3,061,432, pyrazolo-s-triazole as described in Belgian Pat. No. 724,427, and 2-cyanoacetylcumarone as described in U.S. Pat. No. 2,115,394.

The cyan dye-forming couplers which can be used in this invention include phenol compounds and α-naphthol compounds. The compounds of this type are illustrated in U.S. Pat. Nos. 2,275,292, 2,423,730, 2,474,293, 2,895,826, 2,908,573, 3,043,892, 4,026,706, 3,227,550 and 3,253,294.

In general, the couplers described above are further described in, for example, Kirk-Othmer, *Encyclopedia of Chemical Technology,* Vol. 5, pp. 822–825 and Glafkides, *Photographic Chemistry,* Vol. 2, pp. 596–614.

As described above, when such couplers are used in the practice of this invention, dyes are formed by the reaction of these couplers and an oxidized aromatic primary amino silver halide developing agent.

The developing agent described above includes an aminophenol and a phenylenediamine and they may include a mixture of them.

Typical examples of the developing agent with can form the organic substrate materials by combining various couplers are illustrated as follows:

A

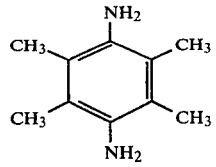

B

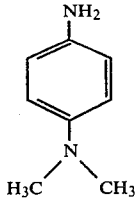

C

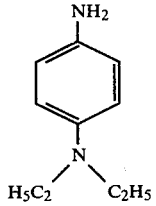

D

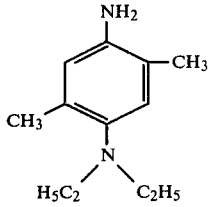

E

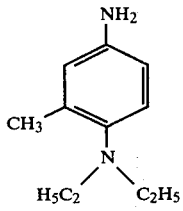

F

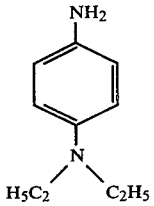

G

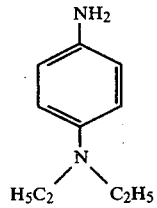

H

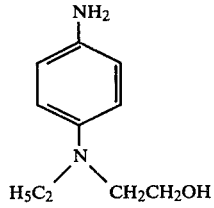

I

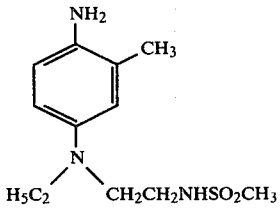

J

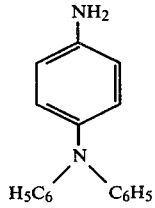

K

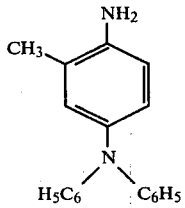

L

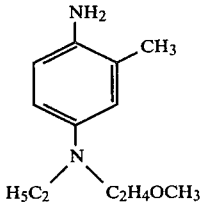

Representative examples of the developing agents capable of forming the substrate materials by coupling into various kinds of couplers according to an embodiment of the present invention are p-phenylenediamines and the derivatives thereof as described in T. H. James, *The Theory of the Photographic Process,* the fourth edition, pp. 315–320, Macmillan, New York (1977). Preferred p-phenylenediamines or the derivatives thereof are p-phenylenediamines in which at least one amino group is substituted by lower alkyl group(s) having 1 to 3 carbon atoms and the derivative thereof, for example, 4-amino-N,N-dimethylaniline, 4-amino-N,N-diethylaniline, 4-amino-3-methyl-N,N-diethylaniline, 4-amino-3-ethyl-N-ethyl-N-(β-methanesulfonamidoethyl)aniline, 4-amino-N-ethyl-N-(β-hydroxyethyl)aniline, 4-amino-3-methyl-N-ethyl-N-(β-hydroxyethyl)aniline and so on.

Cyan, magenta and yellow couplers which are preferably employed are represented by the formulae (V), (VI) or (VII) below, respectively:

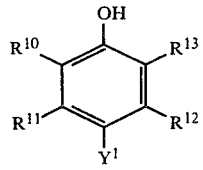

(V)

wherein $R^{10}$, $R^{11}$, $R^{12}$ and $R^{13}$ each represents a hydrogen atom, a halogen atom (e.g., fluorine, chlorine, bromine or iodine), an alkyl group having 1 to 20 carbon atoms (e.g., methyl, ethyl, octyl, dodecyl, tetradecyl, octadecyl, etc.); an alkyl- or aryl-substituted carbamoyl wherein the aryl moiety has 6 to 10 carbon atoms (e.g., methylcarbamoyl, ethylcarbamoyl, dodecylcarbamoyl, tetradecylcarbamoyl, octadecylcarbamoyl, N-phenylcarbamoyl, N-tolylcarbamoyl, etc.); an alkyl- or aryl-substituted sulfamoyl group (e.g., methylsulfamoyl, ethylsulfamoyl, dodecylsulfamoyl, tetradecylsulfamoyl, octadecylsulfamoyl, N-phenylsulfamoyl, N-tolylsulfamoyl, etc.); an alkyl- or aryl-substituted amido group (e.g., acetamido, butylamido, benzamido, phenacetamido, etc.); a sulfonamido group (e.g., benzenesulfonamido), a phosphoric acid amido group, a ureido group, etc.

$R^{10}$ and $R^{11}$ may combine with each other to form a 6-membered carbocyclic ring (e.g., a benzene ring which may further be substituted with a $C_1$–$C_{20}$ alkyl or $C_6$–$C_{14}$ aryl group).

$Y^1$ represents a hydrogen atom, a halogen atom (e.g., fluorine, chlorine, bromine or iodine); or a group which is releasable upon the reaction with the oxidation product of a developing agent (e.g., an alkoxy group wherein the alkyl moiety has 1 to 20 carbon atoms; an aryloxy group wherein the aryl moiety has 6 to 10 carbon atoms; a sulfonamido group, a sulfonyl group, a carbamoyl group, an imido group, an aminosulfonyloxy group, an alkylcarbonyloxy group, an arylcarbonyloxy group, an alkylthio group, an arylthio group, a heterocyclic ring thio group, etc.); the details of which are well known in the art.

The alkyl, carbamoyl, sulfamoyl and amido groups expressed by $R^{10}$, $R^{11}$, $R^{12}$ and $R^{13}$, or the 6-membered ring formed by combining $R^{10}$ and $R^{11}$ with each other can also be substituted with other substituents, for example, a $C_1$–$C_{20}$ alkyl group (e.g., methyl, ethyl, propyl, octyl, dodecyl, tetradecyl, octadecyl, etc.); a $C_6$–$C_{14}$ aryl group (e.g., phenyl, tolyl, naphthyl, etc.); a $C_6$–$C_{14}$ aryloxy group (e.g., phenoxy, 2,5-di(t)-amylphenoxy, etc.); a halogen atom (e.g., chlorine, bromine, fluorine, etc.); and the like.

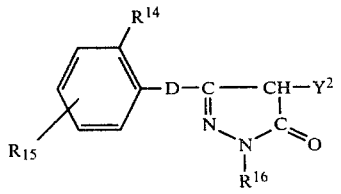

(VI)

wherein $R^{14}$ represents a hydrogen atom, a halogen atom (e.g., chlorine, bromine, fluorine, etc.); a $C_1$–$C_{20}$ alkyl group (e.g., methyl, ethyl, n-propyl, etc.); or a $C_1$–$C_{20}$ alkoxy group (e.g., methoxy, ethoxy, etc.); $R^{15}$ represents a $C_1$–$C_{20}$ alkyl group (e.g., methyl, ethyl, octyl, dodecyl, tetradecyl, octadecyl, etc.); an amido group (e.g., butanamido, decanamido, tetradecanamido, nonadecanamido, etc.); an imido group (e.g., tetradecylsuccinimido, octadecenylsuccinimido, etc.); an N-alkylcarbamoyl group the alkyl moiety of which contains 1 to 20 carbon atoms (e.g., decylcarbamoyl, tetradecylcarbamoyl, octadecylcarbamoyl, etc.); an N-alkoxycarbonyl group the alkyl moiety of which contains 1 to 20 carbon atoms (e.g., decyloxycarbonyl, tetradecyloxycarbonyl, octadecyloxycarbonyl, etc.); an acyloxy group (e.g., valeryloxy, palmitoyloxy, stearoyloxy, oleyloxy, benzoyloxy, toluoyloxy, etc.); a sulfonamido group, a urethane group, etc.; and $R^{16}$ represents a $C_6$–$C_{14}$ aryl group (e.g., phenyl, naphthyl, etc.), said alkyl and aryl groups having 1 to 20 and 6 to 14 carbon atoms, respectively.

D represents an amino group, a carbonylamino group, or a ureido group.

$Y^2$ represents a hydrogen atom, a halogen atom (e.g., chlorine, bromine, etc.); or a group which is releasable upon reaction with the oxidation product of a developing agent (e.g., an arylazo group, an aryloxy group, an acyloxy group, an alkylthio group, an arylthio group, etc.). Such groups are well known.

The alkyl or alkoxy group represented by $R^{14}$, the alkyl, amido, N-alkylcarbamoyl, N-alkylsulfamoyl, alkoxycarbonyl or acyloxy group represented by $R^{15}$, or the aryl group represented by $R^{16}$ can also be substituted with other substituents, for example, an alkyl group, an aryl group, an alkoxy group, an aryloxy group, an amido group, an N-alkylcarbamoyl group, an N-alkylsulfamoyl group, an acyloxy group, a carboxy group, a sulfo group, a halogen atom (e.g., chlorine, bromine, fluorine, etc.), or the like.

$$R^{17}-\underset{\underset{O}{\|}}{C}-\underset{\underset{Y^3}{|}}{CH}-\underset{\underset{O}{\|}}{C}-NH-R^{18} \qquad \text{(VII)}$$

wherein $R^{17}$ represents a $C_1$–$C_{20}$ alkyl group (e.g., methyl, ethyl, (t)-butyl, (t)-octyl, etc.) or a $C_6$–$C_{14}$ aryl group (e.g., phenyl) and $R^{18}$ represents a $C_6$–$C_{14}$ aryl group (e.g., phenyl).

$Y^3$ represents a hydrogen atom, a halogen atom (e.g., chlorine, bromine, etc.), or a group which is releasable upon reaction with the oxidation product of a developing agent, for example, a heterocyclic nuclei (e.g., naphthoimido, succinimido, 5,5-dimethylhydantoinyl, 2,4-oxazolidinedione residue, imido, pyridone residue, pyridazone residue, etc.), an acyloxy group, a sulfonyloxy group, an aryloxy group, a ureido group, which are well known in the art.

The alkyl or aryl group represented by $R^{17}$ and the aryl group represented by $R^{18}$ can also be substituted with other substituents, for example, an alkyl group, an aryl group, an alkoxy group, an aryloxy group, an amido group, an N-alkyl-carbamoyl group, an N-alkylsulfamoyl group, an acyloxy group, a carboxy group, a sulfo group, a sulfonamido group, a halogen atom, etc., the alkyl and aryl moieties of which contain 1 to 20 and 6 to 14 carbon atoms, respectively.

Then, practical examples of the couplers which can form organic substrate materials by the reaction with the aforesaid or other developing agents are as follows:

(V - 1)

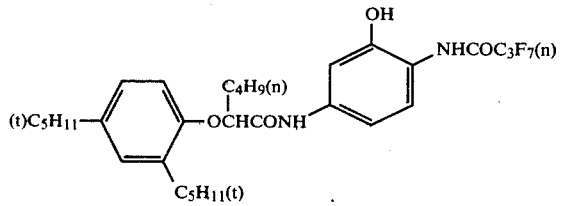

(V - 2)

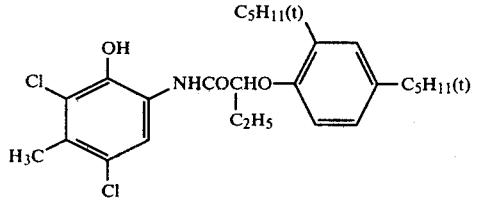

(V - 3)

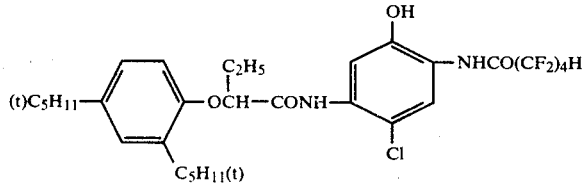

(V - 4)

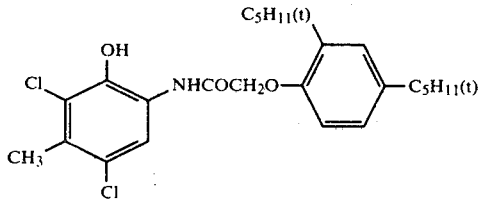

-continued
(V - 5)
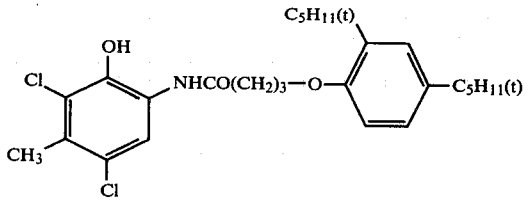
(V - 6)
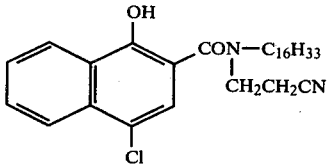
(V - 7)
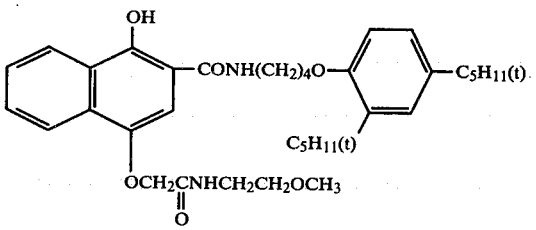
(V - 8)
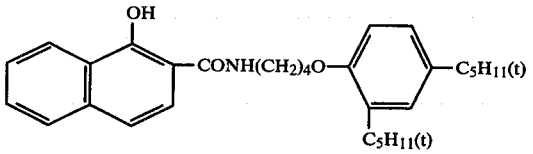
(V - 9)
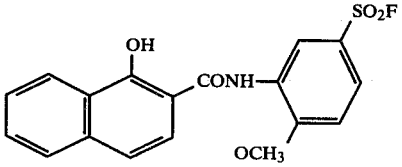
(VI - 1)
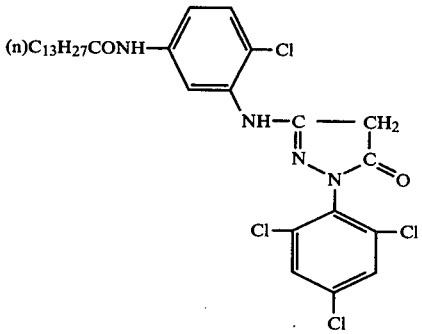
(VI - 2)
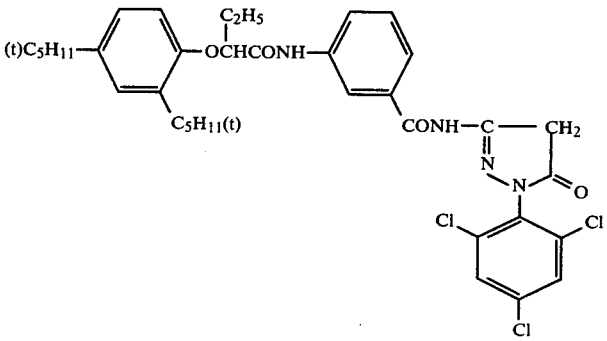

-continued
(IV-3)
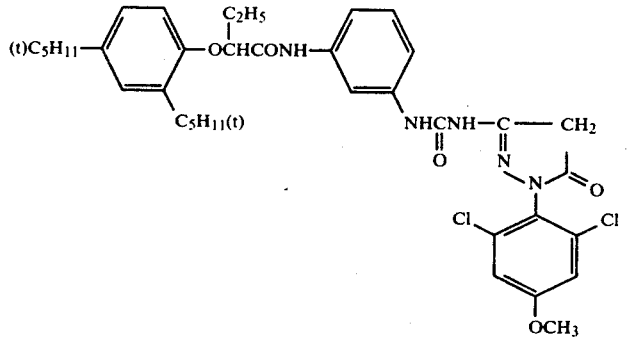
(VII - 1)
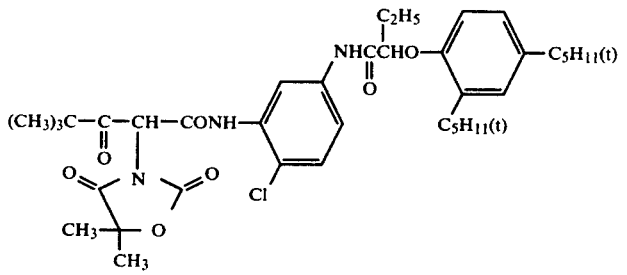
(VII - 2)
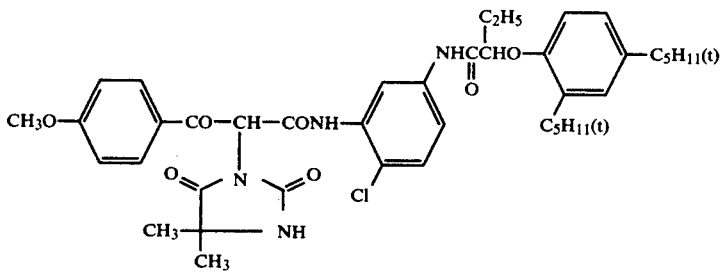
Other practical examples of dyes used as the organic substrate materials in this invention are as follows:
(VIII - 1)
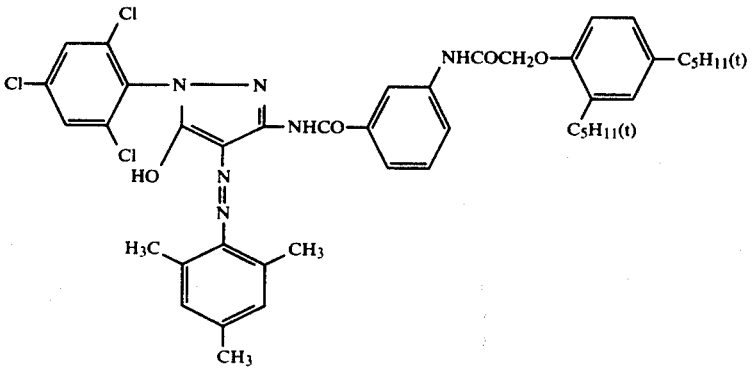
(VIII - 2)
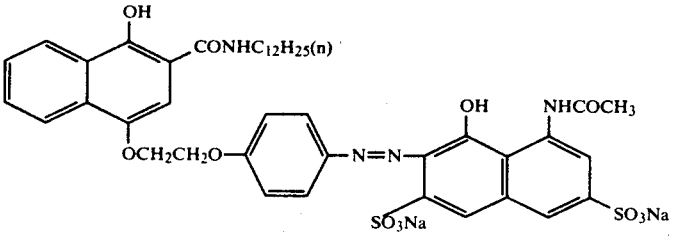

-continued
(VIII - 3)
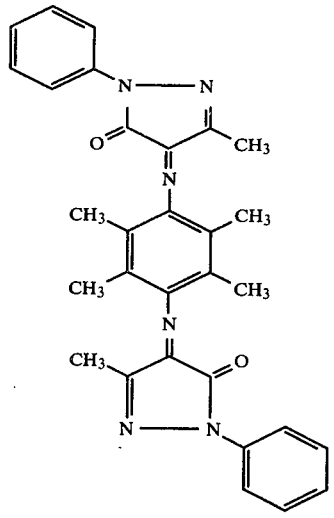
(VIII - 4)
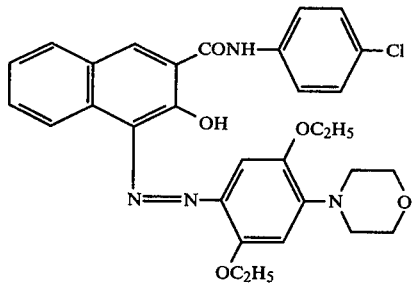
(VIII - 5)
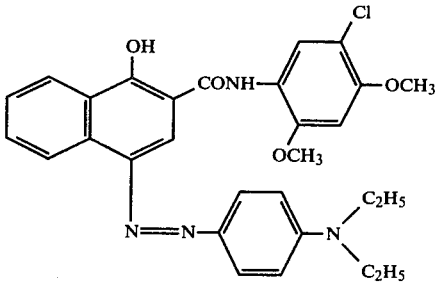
(VIII - 6)
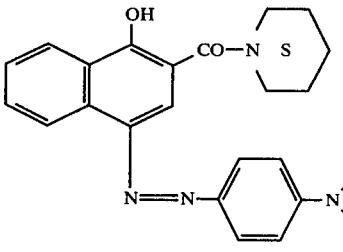
(VIII - 7)
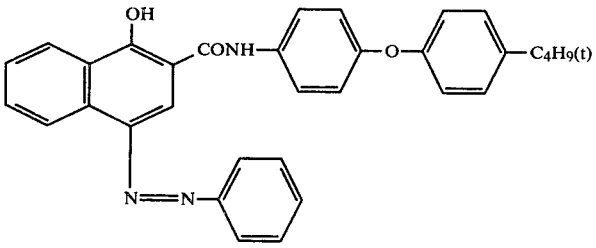

-continued
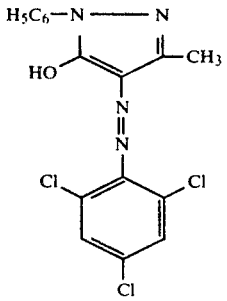
(VIII - 8)
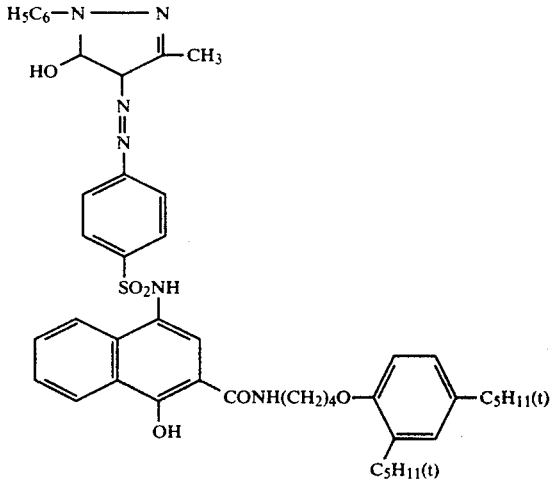
(VIII - 9)
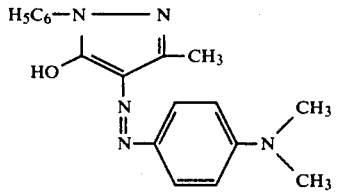
(VIII - 10)
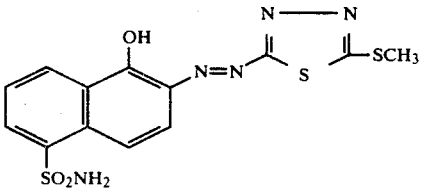
(VIII - 11)
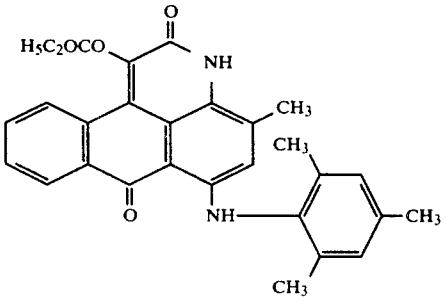
(VIII - 12)
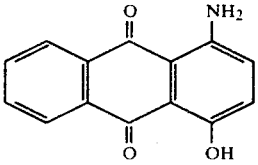
(VII - 13)

-continued
(VIII - 14)
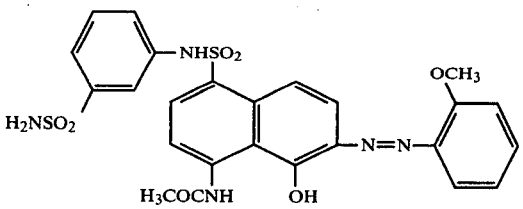
(VIII - 15)
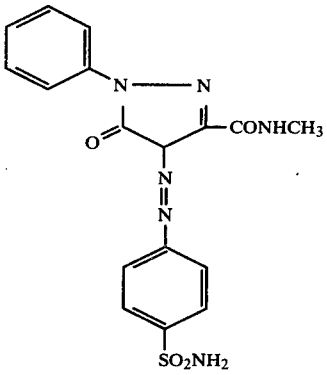
(VIII - 16)
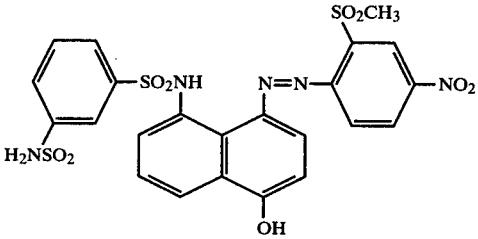
(VIII - 17)
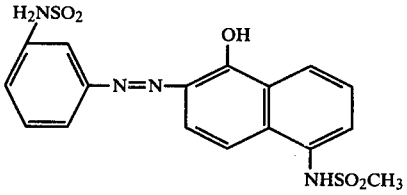
(VIII - 18)
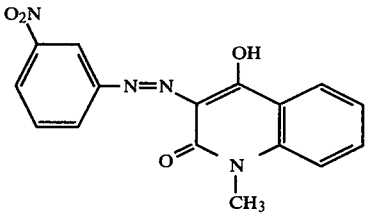
(VIII -19)
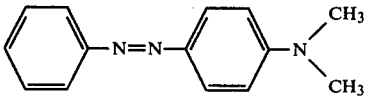
(VIII - 20)
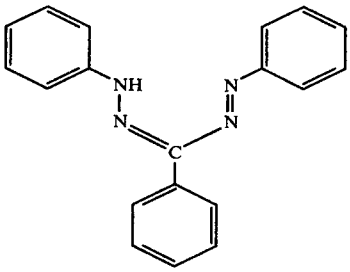

-continued
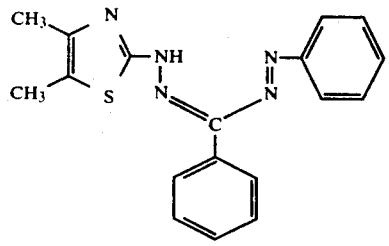
(VIII - 21)
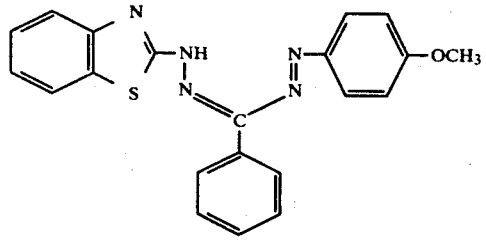
(VIII - 22)
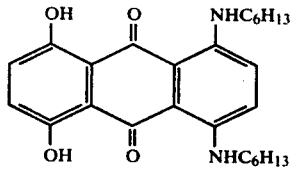
(VIII - 23)
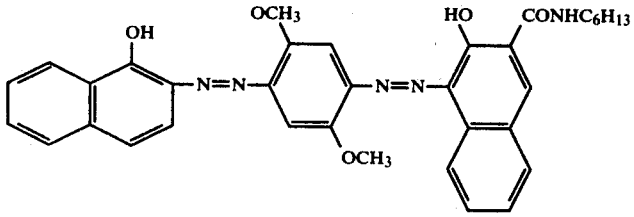
(VIII - 24)
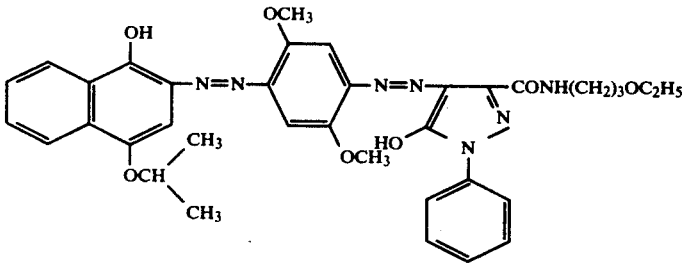
(VIII - 25)
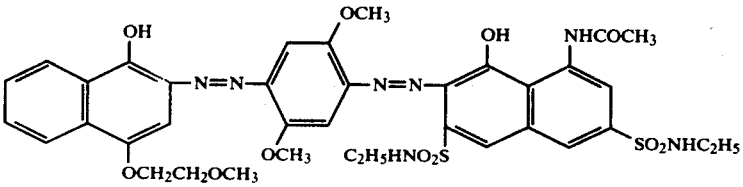
(VIII - 26)
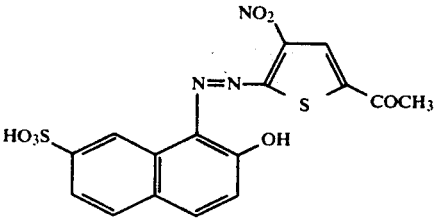
(VIII - 27)

-continued
(VIII - 28)
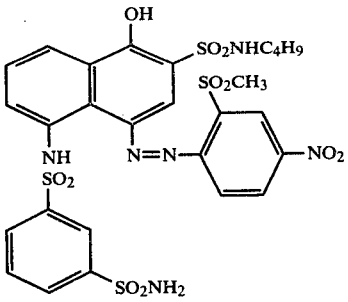
(VIII - 29)
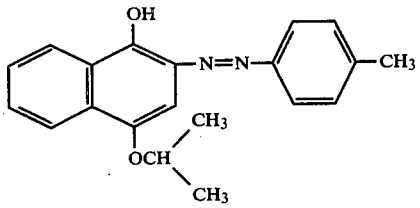
(VIII - 30)
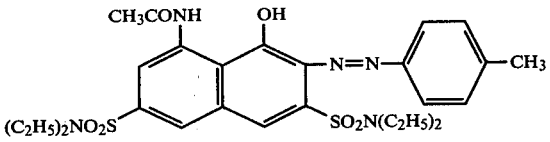
(VIII - 31)
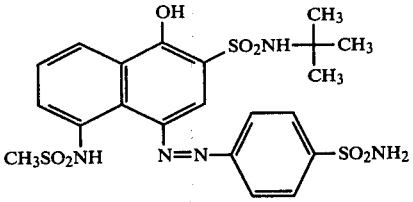
(VIII - 32)
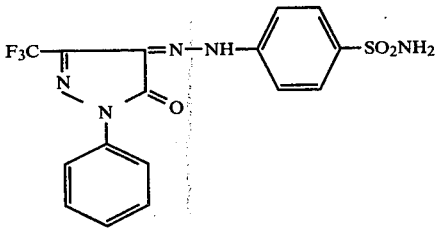
(VIII - 33)
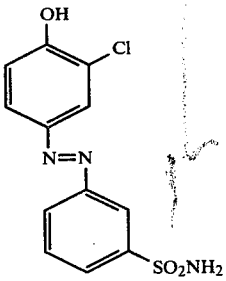
(VIII - 34)
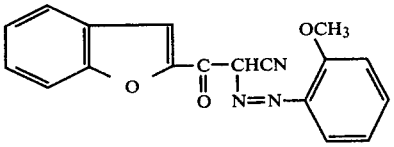
(VIII - 35)
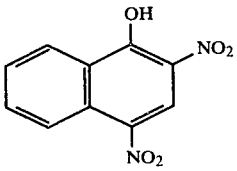

-continued

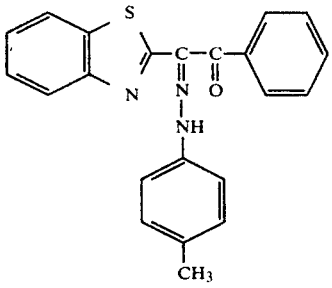

(VIII - 36)

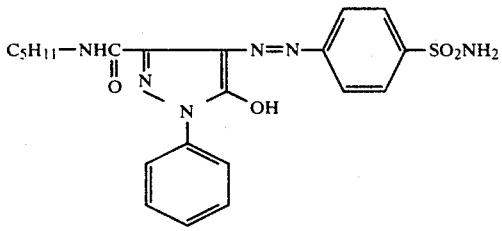

(VIII - 37)

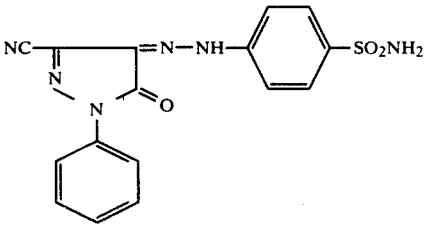

(VIII - 38)

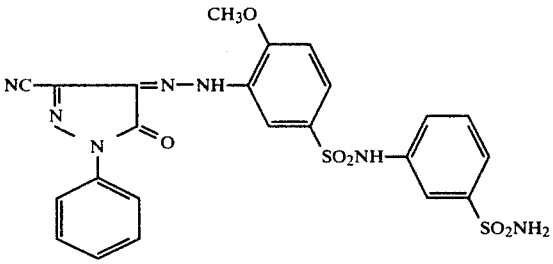

(VIII - 39)

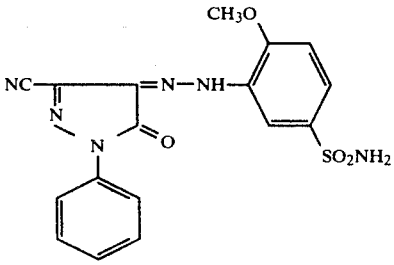

(VIII - 40)

Other types of dyes preferably used in this invention are dyes formed by the oxidation of DRR compounds such as described in U.S. Published Application No. 351,673, U.S. Pat. Nos. 3,932,381, 3,928,312, 3,931,144, 3,954,476, 3,929,760, 3,942,987, 3,932,380, 4,013,635, and 4,013,633, Japanese Patent Application (OPI) Nos. 113,624/76, 109,928/76, 104,343/76 and 4,819/77, Japanese Patent application No. 64,533/77, now Japanese Patent Application (OPI) No. 149,328/78 and *Research Disclosure,* 86–74 (1976, Nov.) and *Research Disclosure,* No. 13,024 (1975).

Dyes released by the reaction of an oxidized color developing agent and the DDR couplers also used in this invention are described in British Pat. Nos. 840,731, 904,364, 932,272, 1,014,725, 1,038,331, 1,066,352 and 1,097,064, Japanese Patent Application (OPI) No. 133,021/76, U.S. (U.S. Defensive publication) T900,029, and U.S. Pat. No. 3,227,550. Still other types of dyes suitably used in this invention are dye developing agents such as described in Japanese Patent Publication Nos. 182/57, 18,332/57, 32,130/73, 43,250/71 and 2,618/74.

Dyes formed in a silver dye bleach process are also suitable for use in the present invention. As yellow dyes used for the purpose, there are azo dyes such as Direct Fast Yellow GC (C.I. 29,000) Chrysophenine(C.I. 24,895), etc.: benzoquinone dyes such as Indigo Golden Yellow IGK (C.I. 59,101), Indigosol Yellow 2GB (C.I. 61,726), Algosol Yellow GCA-CF (C.I. 67,301), Indanthrene Yellow GF (C.I. 68,420), Mikethrene Yellow GC (C.I. 67,300), Indanthrene Yellow GK (C.I. 68,405), etc.; anthraquinone series soluble vat dyes; polycyclic soluble vat dyes; and other vat dyes. As magenta dyes used for the above-mentioned purpose, there are illustrated azo dyes such as Sumilight Supra Rubinol B (C.I. 29,225), Benzo Brilliant Geranine B (C.I. 15,080), etc.; indigoid dyes such as Indigosol Brilliant Pink IR (C.I. 73,361), Indigosol Violet 15R (C.I. 59,321), Indigosol Red Violet IRRL (C.I. 59,316), Indanthrene Red Violet RRK (C.I. 67,895), Mikethrene Brilliant Violet BBK (C.I. 6335), etc.; benzoquinone series soluble vat dyes; anthraquinone series soluble vat dyes; heterocyclic soluble vat dyes; and other vat dyes. As cyan dyes used for the above purpose, there are illustrated azo dyes such as Direct Sky Blue 6B (C.I. 24,410), Direct Brilliant Blue 2B (C.I. 22,610), Sumilight Supra Blue G (C.I. 34,200), etc.; phthalocyanine dyes such as Sumilight Supra Turkish Blue G (C.I. 74,180), Mikethrene Brilliant Blue 4G (C.I. 47,140), etc.; Indanthrene Turkish Blue 5G (C.I. 69,845),Indanthrene Blue GCD (C.I. 73,066), Indigosol 04G (C.I. 73,046), Anthrasol Green (C.I. 59,826), etc.

While the mechanism whereby the complex of the present invention improves light fastness is not entirely clear, it is believed that upon exposure to light the organic substrate (dye image) is excited to a triplet state whereupon the complex interacts with the excited dye to absorb the high energy and thus restore the dye to its original state. Alternatively, oxygen may be excited upon exposure to a singlet state in which case the complex absorbs the high energy of the excited oxygen and restores the oxygen to its original state. In any case the complex of the present invention effectively improves the light fastness of the organic substrate.

As described above, the metal complexes are used in this invention for stabilizing the organic substrate materials. These compounds may be incorporated in one or more silver halide emulsion layers of a color photographic material. Also, these compounds may be incorporated in a layer included in the non-sensitive portion of color photographic transfer materials. The complexes can be supplied for stabilizing photographic images by incorporation into the hydrophilic colloids constituting the photographic layers of a photographic element. The complexes are incorporated as a solution thereof in an organic solvent having low boiling point or an organic solvent miscible with water which does not adversely influence the photographic properties of the photographic layers, such as, for example, an alcohol (e.g., methanol, ethanol, isopropanol, butanol, etc.) an ether (e.g., dimethyl ether, ethyl methyl ether, diethyl ether, 1-ethoxypropane, etc.), a glycol (e.g., 1,2-ethanediol, 1,2-propanediol, 1,3-propane-diol, etc.), a ketone (e.g., acetone, ethyl methyl ketone, 3-pentanone, etc.), an ester (e.g., ethyl formate, methyl acetate, ethyl acetate, etc.), an amide (e.g., formamide, acetamide, succinamide, etc.), and the like. It is desirable that the complex be incorporated before coating, such as when producing silver halide photographic emulsions, when forming an emulsified dispersion of couplers, or when preparing photographic coating compositions.

In order to introduce these complexes into hydrophilic colloids constituting photographic layers, methods usually employed for dispersing couplers in the color photographic fields may be employed. In this regard, U.S. Pat. Nos. 2,304,939 and 2,322,027 disclose the use of high boiling organic solvents for dissolving these materials. Other applicable methods are described in U.S. Pat. Nos. 2,801,170, 2,801,171 and 2,949,360, wherein low boiling or water-soluble organic solvents are used together with high boiling organic solvents.

Examples of the high boiling organic solvents which are effective for dispersing the substrate material and metal complexes in this invention are di-n-butyl phthalate, benzyl phthalate, triphenyl phosphate, tri-o-cresyl phosphate, di-phenylmono-p-tert-butylphenyl phosphate, monophenyl-di-p-tert-butylphenyl phosphate, diphenyl-mono-o-chlorophenyl phosphate, monophenyl-di-o-chlorophenyl phosphate, 2,4-di-n-amylphenol, 2,4-di-t-amylphenol, N,N-diethyllaurylamide as well as trioctyl phosphate and trihexyl phosphate described in U.S. Pat. No. 3,676,137.

The low boiling or water-soluble organic solvents which can be advantageously used together with these high boiling organic solvents are disclosed in, for example, U.S. Pat. Nos. 2,801,171, 2,801,170 and 2,949,360.

These organic solvents include:

(1) low boiling organic solvents substantially immiscible in water, such as, for example, methyl acetate, ethyl acetate, propyl acetate, butyl acetate, isopropyl acetate, ethyl propionate, sec-butyl alcohol, ethyl formate, nitromethane, nitroethane, carbon tetrachloride, chloroform, etc., and (2) water-miscible organic solvents such as, for example, methyl isobutyl ketone, β-ethoxyethyl acetate, β-butoxytetrahydrofurfuryl adipate, diethylene glycol monoacetate, methoxytriglycol acetate, acetonylacetone, diacetone alcohol, ethylene glycol, acetone, methanol, ethanol, acetonitrile, dimethylformamide, dioxane, etc.

In general, the complex of the formula (I) is dissolved or suspended in an appropriate solvent which is chosen depending upon the physical properties of the complex used from water, water-miscible and water-immiscible organic and inorganic solvents (the details of which are described in U.S. Pat. No. 3,966,468) and the organic substrate material is dissolved or suspended therein. Alternatively, again depending upon the physical properties of the compounds, solutions and/or dispersions may be prepared separately and subsequently mixed. For example, a fluorescent whitening agent may be dissolved or suspended in an organic or inorganic solvent such as water or dimethyl formamide, etc., together with the complex of the present invention or separately; and the mixture may be coated onto or incorporated into a suitable base substance. An adjacent double layer coating is possible and in some cases may be preferred if some diffusion between the contiguous layers occurs and light fastness improvement is effected.

The present invention can also be used to improve the light fastness of a colored polymer. A colored polymer is a polymer containing a coloring material in a state of molecular dispersion or melt. The polymer is represented by natural resins other than gelatin, e.g., cellulose and derivatives thereof, vinyl resins, polycondensates, silicone resins, alkyd resins, polyamides, paraffin and mineral waxes as described in U.S. Pat. No. 3,966,468. Where it is desired to improve the light fastness in a colored polymer for use of agricultural vinyl sheets, the colored polymer and complex of the formula (I) are likewise mixed in the form of a solution, dispersion, etc., followed by extrusion molding, etc., in a conventional manner.

In the case of a photographic material, the substrate material (the dye image) and the complex each may be present in one or more of the hydrophilic colloid layer making up a photographic element (e.g., a film, paper, diffusion transfer unit, etc.). It is preferred that the metal chelate complex and the organic substrate material be present (i.e., coexist) in the same emulsion layer, of course, the effect of the present invention can also be attained when the complex and substrate are present in contiguous layers and diffusion occurs between the layers. Where undesirable diffusion occurs, conventional mordanting techniques could be applied to the present invention.

In the case of incorporating the complex into a silver halide emulsion layer, the complex can be incorporated into each emulsion layer making up the photographic element. In this case, the total amount of complex present is in the range set forth below. The complex and substrate may be present in non-light-sensitive elements or layers such as the dye image-receiving layer used in diffusion transfer film units. In the case of image transfer units, the metal chelate complex is preferably located in the layer in which the dye images are finally found. i.e., in an image-receiving layer. Usually, the dye images formed in the image-receiving layer do not diffuse further into any other layer(s) so that the complex is easily maintained in the vicinity of the dye. When the organic substrate material and the complex are incorporated in such a non-photosensitive image-recording or image-receiving element, they are mordanted. The complex contains a ligand capable of retaining it in the mordant layer of the image-receiving element so that it does not diffuse away from the dye stabilized thereby.

A number of types of image transfer film units are particularly appropriate for the practice of the present invention; One is the imbibition transfer film unit set fourth in U.S. Pat. No. 2,882,156. The present invention can be further used in conjunction with the color image transfer film unit described in U.S. Pat. Nos. 2,087,817, 3,185,567, 2,983,606, 3,253,915, 3,227,550, 3,227,551, 3,227,552, 3,415,646, 3,594,164 and 3,594,165 and Belgian Pat. Nos. 757,959 and 757,960.

The organic substrate materials and the complexes used in the practice of this invention can be used together with the materials as described in *Product Licensing Index,* Vol. 92, No. 9232, 107–110 (1971, December) according to the manner as described therein.

Any amount of the complex will bring about some improvement in the light fastness of the organic substrate and theoretically there is no upper limit for the amount of the complex. Preferably, the complex is present in an amount of at least 0.1 mol% based on 1 mol of the organic substrate material, more preferably in an amount of 0.1 to 1,000 mol%, and most preferably in an amount of 1 to 300 mol%. In the case of a photographic material, the amount is often expressed in terms of a weight unit per square meter of photographic material which can be calculated from the parameters set out above. In the case of a photographic material, the complex is preferably present in an amount of at least 1 micromole per square meter of the photographic material, and more preferably in an amount of from about 10 to $1\times10^4$ micromoles per square meter of the material. The concentration of the substrate material corresponds in general to that for the image forming material usually adopted in color photographic technology. As is well known to those skilled in the art, the substrate material is preferably present in the range of from about 10 to $10^4$ micromoles per square meter of the photographic material. A more preferable range is from about 100 to about $3\times10^3$ micromoles per square meter of the photographic product.

The organic substrate material used in this invention generally has a maximum absorption peak in the wavelength region less than about 800 nm. However, the organic substrate material having the maximum absorption peak in the region of from about 300 nm to about 800 nm is preferred and the organic substrate material having the maximum absorption peak in the range of from about 400 nm to about 800 nm is most preferred.

In photographic materials based on this invention, any material ordinarily used as the supports for photographic materials may be used as the support therefor in this invention. Examples thereof are cellulose nitrate films, cellulose acetate films, cellulose acetate butyrate films, cellulose acetate propionate films, polystyrene films, polyethylene terephthalate films, polycarbonate films, laminated sheets of these films, and papers. Also, baryta-coated papers, papers coated with $\alpha$-olefin polymer, in particular, a polymer of an $\alpha$-olefin having 2 to 10 carbon atoms, such as polyethylene, polypropylene, etc., and plastic films the surface of which have been roughened to improve their adhesion to other polymers as shown in Japanese Patent Publication No. 19,068/72 are preferably used as the supports for photographic materials.

In photographic materials used in the method of this invention, various hydrophilic colloids are used. Examples of the hydrophilic colloids used as the binders for photographic silver halide emulsions and/or other coating compositions for photographic layers are gelatin; colloidal albumin; casein; cellulose derivatives such as carboxymethyl cellulose, hydroxyethyl cellulose, etc.; sugar derivatives such as agar, sodium alginate, starch derivatives, etc.; synthetic hydrophilic colloids such as polyvinyl alcohol, poly-N-vinylpyrrolidone, polyacrylic acid copolymers, maleic anhydride copolymers, polyacrylamide, and the derivatives or partially hydrolyzed products thereof. If necessary, a mixture of two or more of these colloids which are compatible with each other may be used.

Among the aforesaid materials, gelatin is most generally used but gelatin may be replaced partially or wholly with a synthetic polymer. Furthermore, so-called gelatin derivatives, that is, gelatin modified by treatment with an amino group, an imino group, a hydroxy group, a carboxy group, etc., contained in the gelatin molecule as a functional group with a reagent having a functional group which can react with these groups or graft gelatin having bonded thereto the molecular chain of another polymer may be used in place of gelatin.

The silver halide photographic emulsion layers or other photographic layers of photographic materials used in this invention may further contain synthetic polymers such as, for example, water-dispersed vinyl polymers in the form of a latex, in particular, a compound or compounds capable of increasing the dimensional stability of the photographic materials solely or together with a hydrophilic water-permeable colloid.

The silver halide photographic emulsion used in the method of this invention is usually prepared by mixing an aqueous solution of a water-soluble silver salt (e.g., silver nitrate) and an aqueous solution of a water-soluble halogen salt (e.g., potassium bromide) in the presence of a water soluble polymer solution such as an aqueous solution of gelatin. As such a silver halide, there is silver chloride, silver bromide as well as mixed silver halides such as silver chlorobromide, silver chloroiodide, silver chloroiodobromide, etc. These silver halide grains may be prepared according to a known or conventional processes. As a matter of course, they may be advantageously prepared using the so-called single jet method or double jet method or the controlled double jet method. Also, two or more different silver halide emulsions prepared separately may be used in mixture.

The above-mentioned silver halide photographic emulsions may further contain various compounds for preventing a reduction in sensitivity and the formation of fog during production, preservation or processing of the photographic material. As examples of such compounds, there are 4-hydroxy-6-methyl-1,3,3a,7-tetrazaindene, 3-methylbenzothiazole, 1-phenyl-5-mercaptotetrazole as well as many heterocyclic compounds, mercury-containing compounds, mercapto compounds, metal salts, etc.

The silver halide emulsions used in this invention may also be chemically sensitized in a conventional manner. As examples of chemical sensitizers used for the purpose, there are gold compounds such as an aurichlorate, gold trichloride, etc.; salts of noble metals such as platinum, palladium, iridium, and rhodium; sulfur compounds capable of forming silver sulfide by causing reaction with a silver salt, such as sodium thiosulfate, etc.; stannous salts, amines; and other reducing materials.

The silver halide photographic emulsions used in this invention may, if necessary, be subjected to a spectral sensitization or super dye sensitization using cyanine dyes such as cyanine, merocyanine, carbocyanine, etc., solely or as a combination thereof or using a combination of the cyanine dye or dyes and styryl dyes. These dyes are properly selected according to the objects and use of the photographic materials, such as the wavelength region and sensitivity to be stabilized.

The hydrophilic colloid layers of photographic materials used in the method of this invention can be, if necessary, hardened by various cross-linking agents, for example, aldehyde series compounds, active halogen compounds, vinylsulfone compounds, carbodiimide compounds, N-methylol compounds, epoxy compounds, etc.

In applying the method of this invention to color photographic materials, after image exposure, the color photographic material may be processed in a conventional manner to form color images. The main processing steps in such case are color development, bleach, and fix and, if necessary, other steps such as washing and stabilization. In these steps, two or more steps may be performed in one step as blix step. The color development is usually performed in an alkaline solution containing an aromatic primary amine developing agent. Preferred examples of the aromatic primary amine developing agent are the compounds shown by formulae (A) to (L) described above.

In applying the method of this invention to color photographic materials, wherein the color photographic material is a color photographic diffusion transfer film unit, the processing of the photographic material is carried out automatically in the photographic material. In this case, a color developer containing a color developing agent is contained in a rupturable container. As the developing agent, N-methylaminophenol, 1-phenyl-3-pyrazolidone, 1-phenyl-4,4-dimethyl-3-pyrazolidone, 1-phenyl-4-methylhydroxymethyl-3-pyrazolidone, 3-methoxy-N,N-diethyl-p-phenylenediamine, etc., in addition to the compounds shown by formulae (A) to (L) above are suitable.

For forming color images in photographic materials based on this invention, various known methods can be used, such as the coupling reaction of the above-described dye-forming color couplers and the oxidation product of a p-phenylenediamine series color developing agent; development with a dye developer; the oxidation cleavage reaction of DRR compounds; the dye-releasing reaction upon coupling of DDR couplers; the dye-forming reaction upon coupling reaction of DDR couplers and a silver dye bleaching process.

Accordingly, this invention can be applied to various kinds of color photographic materials such as color positive films, color papers, color negative films, color reversal films, color diffusion transfer film units, silver dye bleaching photographic materials, etc.

The following examples are provided for further understanding of the method of this invention. They are not to be construed as limiting.

EXAMPLE 1

In a mixture of 3 ml of tricresyl phosphate and 5 ml of ethyl acetate was dissolved 0.1 g of 1-(2,4,6-trichlorophenyl)-3-(2-chloro-5-tetradecanamido)anilino-4-{4-(N-ethyl-N-β-methanesulfonamidoethyl)aminophenylimino}-5-oxo-2-pyrazoline and the solution was dispersed by emulsification in 10 g of an aqueous 10% gelatin solution containing 1 ml of an aqueous solution of 1% sodium dodecylbenzenesulfonate. Then, the emulsified dispersion was mixed with 10 g of an aqueous 10% gelatin solution and the mixture was coated on a paper support having coated on the both surfaces polyethylene to provide Sample A.

Also Sample B was prepared in the same manner as the case of preparing Sample A except that 30 mg of Compound I-1 of this invention was added when preparing the above-described emulsified dispersion and Sample C and Sample D were prepared by the same manner as the case of preparing Sample A except that 15 mg or 150 mg of 2,5-di-tert-octylhydroquinone known as light fading preventing agent for dye was added at the case of preparing the emulsified dispersion. The amount of the dye thus coated was 60 mg/m$^2$ in each sample. The amounts of the light fading preventing agent correspond to 18 mg/m$^2$ for compound I-1, 9 mg/m$^2$ for 15 mg of the hydroquinone and 90 mg/m$^2$ for 150 mg of the hydroquinone. These samples A-D were subjected to a fading test for 48 hours by a xenone tester of 200,000 lux illumination using a ultraviolet cut filter C-40, made by Fuji Photo Film Co., Ltd. The results are shown in Table I.

TABLE I

| Sample | Initial density | Density after test |
|---|---|---|
| A | 0.82 | 0.12 |
| B | 0.81 | 0.70 |
| C | 0.81 | 0.23 |
| D | 0.79 | 0.41 |

The measurement was made by means of Macbeth Densitometer RD 514 using a green filter of Status AA. It has been confirmed that fading of Sample B containing Compound I-1 of this invention is very small as compared with the other samples and, in particular, Sample C and Sample D show almost no effect for fade prevention in spite of the fact that they contain di-tert-octylhydroquinone in an amount equimolar to and 10 mole times the amount of Compound I-1 in Sample A. The result shows that Compound I-1 of this invention has an astonishing effect for the prevention of light fading of a dye.

EXAMPLE 2

In a mixture of 0.2 ml of 1 N sodium hydroxide solution and 2 ml of methanol was dissolved 0.1 g of Compound VIII-2 and the solution was added to 10 g of an aqueous 10% gelatin solution. The mixture was coated on a paper support having coated on the both surfaces polyethylene at a coverage of Compound VIII-2 of 80 mg/m$^2$ to provide Sample E.

Also, Sample F was prepared by the same manner as the case of preparing Sample E except that a solution of 40 mg of Compound I-33 (corresponding to a coating rate of 32 mg/m$^2$) in 2 ml of methanol was added directly before coating and further Sample G was prepared as comparison sample by the same manner as the case of preparing Sample E except that 20 mg of 2,5-ditertoctylhyroquinone (corresponding to a coating rate of 16 mg/m$^2$), a known light fade preventing agent for dye was added. These samples were subjected to a fading test for 12 hours using a ultraviolet absorption filter as in Example 1. The results are shown in Table II.

Table II

| Sample | Initial density | Density after test |
|---|---|---|
| E | 0.90 | 0.11 |
| F | 0.90 | 0.64 |
| G | 0.91 | 0.29 |

The measurement was performed by a Macbeth densitometer as in Example 1. From the experimental result, it is understood that Compound I-33 of this invention shows a very high light fading prevention effect.

EXAMPLE 3

In a mixture of 30 ml of tricresyl phosphate, 5 ml of dimethylformamide, and 15 ml of ethyl acetate was dissolved 10 g of a magenta coupler, 1-(2,4,4-trichlorophenyl)-3-{(2-chloro-5-tetradecanamido)anilino}-2-pyrazolin-5-on and the solution was dispersed by emulsification on 80 g of an aqueous 10% gelatin solution containing 8 ml of an aqueous solution of 1% sodium dodecylbenzenesulfonate.

Then, the emulsified dispersion was mixed with 145 g of a green-sensitive silver chlorobromide emulsion (50 mole% Br, containing 7 g of Ag) and after adding thereto sodium dodecyl benzenesulfonate as a coating aid, the resultant mixture was coated on a paper support having coated on both surfaces thereof polyethylene at a coverage of the coupler of 400 mg/m$^2$ to provide Sample H.

Also, Sample I was prepared by the same manner as the case of preparing Sample Y except that 2.5 g of Compound II-3 of this invention (corresponding to a coating rate of 100 mg/m$^2$) was added at the preparation of the emulsified dispersion and further Sample J was prepared by the same manner as the case of preparing Sample H except that 1.0 g of 2,5-di-tert-octylhydroquinone (corresponding to a coating rate of 25 mg/m$^2$) was added. These samples were exposed for 1 second at 1000 lux and processed by the following processing compositions:

| Developer | |
|---|---|
| Benzyl Alcohol | 15 ml |
| Diethylenetriamine Tetraacetic Acid | 5 g |
| KBr | 0.4 g |
| $Na_2SO_3$ | 5 g |
| $Na_2CO_3$ | 30 g |
| Hydroxylamine Sulfate | 2 g |
| 4-Amino-3-methyl-N-ethyl-N-β-(methanesulfonamido)-ethylaniline . $3/2H_2SO_4$ . $H_2O$ | 4.5 g |
| Water to make | 1000 ml |
| | pH 10.1 |
| **Blix solution** | |
| Ammonium Thiosulfate (70 wt %) | 150 ml |
| $Na_2SO_3$ | 5 g |
| Na Fe(EDTA) | 40 g |
| EDTA | 4 g |
| Water to make | 1000 ml |
| | pH 6.8 |

| Processing step | Temperature | Time |
|---|---|---|
| Development | 33° C. | 3 min. 30 sec. |
| Bleach | 33° C. | 1 min. 30 sec. |
| Wash | 28–35° C. | 3 min. |

Each sample having color images thus formed was exposed to sun light for 2 weeks using Ultraviolet Absorption Filter C-40 (made by Fuji Photo Film Co., Ltd.) cutting wave lengths shorter than 400 nm. The results are shown in Table III. The measurement was performed by means of Macbeth Densitometer RD-514 (using Status AA filter) and the density change of the portion that the initial density was 2.0 was measured.

Table III

| Sample | Density after test of the portion of initial density 2.0 | Dye remain percentage |
|---|---|---|
| H | 0.52 | 26% |
| I | 1.76 | 88% |
| J | 1.34 | 67% |

Dye remain percentage = density after fading/2.0 × 100

From the above result, it is understood that Compound II-3 of this invention be an effective fading prevention agent.

EXAMPLE 4

A solution of 15 mg of a dye having the structure below and 500 mg of polycarbonate, Lexan 145 (tradename, manufactured by General Electric Co., Ltd.) in 100 ml of dichloromethane was coated onto glass plate using a spinner. A magenta-colored film of 5.5μ thickness was thus prepared as Sample K.

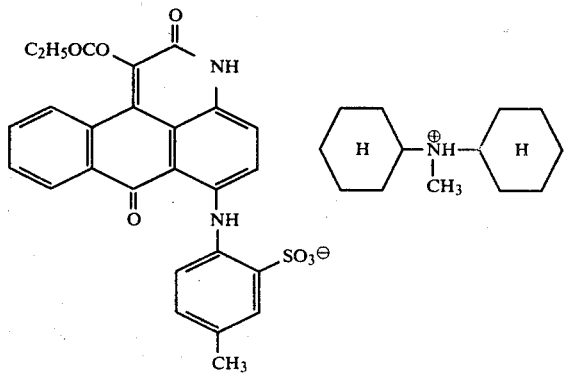

In a similar manner, a colored film was prepared as Sample L except that Compound I-51 were further incorporated into the solution.

The coating rate of the dye and the fade prevention compounds were 500 mg/m$^2$ and 50 mg/m$^2$, respectively.

The thus obtained films were exposed to sunlight for one month and a color fading test was carried out. The results are shown in Table IV below, in which density was measured at 550 nm.

Table IV

| Sample | Density after test of the portion of initial density | Density after Fading |
|---|---|---|
| K | 1.0 | 0.50 |
| L | 1.0 | 0.92 |

It can be clearly seen from the results that Sample L containing the Chelate complex of the present invention provides a superior light fastness, even after the one month fading test, to Sample K containing no compound of the invention.

EXAMPLE 5

In a manner similar to Example 3, Sample M (Same as Sample H) was prepared.

Also, Sample N was prepared by the same manner as the case of preparing Sample I except that 2.0 g of Compound I-51 of this invention was added at the preparation of the emulsified despersion and further Sample O was prepared by the same manner as the case of preparing Sample M (i.e., Sample H) except that 0.20 g of Compound IV (for comparison) described in U.S. Pat. No. 4,050,938 issued to Smith Jr., et al., having the formula below, was added.

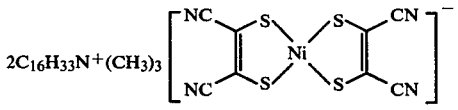

These samples were exposed for 1 second at 1000 lux and processed and then exposed to sunlight in a manner similar to Example 3.

Then, the measurement was performed by means of Macbeth Densitometer RD-514 (using Status AA filter) and the density change of the portion that the initial density was 1.0 was measured.

Table V

| Sample | Relative Photographic Speed | Density after test of the portion of Initial Density 1.0 |
|---|---|---|
| M | 100 | 0.26 |
| N | 95 | 0.90 |
| O | 1 | 0.50 |

As can be clearly seen from the data above, Sample O containing the known fade prevention compound shows poor effect in preventing for fading color, further accompanied by a marked drop in relative photographic speed by 1/100. Compound I-51 of this invention is a very effective fade prevention agent without substantially reducting its photographic speed, which is surprising.

While the invention has been described in detail and with reference to specific embodiments thereof, it will be apparent to one skilled in the art that various changes and modifications can be made therein without departing from the spirit and scope thereof.

What is claimed is:

1. An element comprising an organic substrate material which is stabilized against the action of light and comprises the combination of at least one of the complexes represented by following formulae I, II, III, or IV with at least one organic substrate material in an amount effective to stabilize the substrate material to light;

I

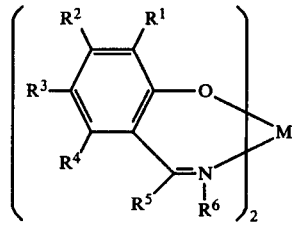

II

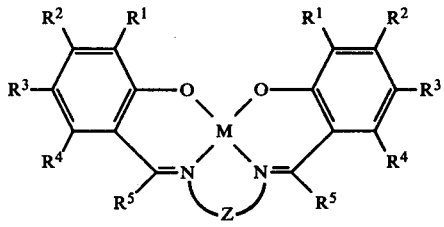

III

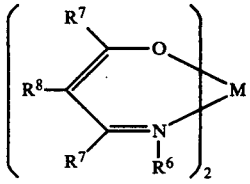

IV

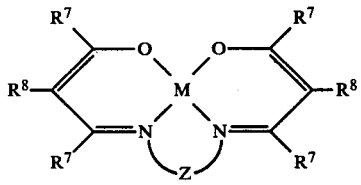

wherein M represents Cu, Co, Ni, Pd, or Pt; $R^1$, $R^2$, $R^3$, or $R^4$ each represents a hydrogen atom, a halogen atom, a cyano group, an alkyl group, an aryl group, a cycloalkyl group, or a heterocyclic group, each of which can be bonded directly or through a divalent connecting group to the carbon atom of a benzene ring, or $R^1$ and $R^2$; $R^2$ and $R^3$; or $R^3$ and $R^4$ combine to represent the non-metallic atoms necessary to complete a 6-membered ring; $R^5$ and $R^8$ each represents a hydrogen atom, an alkyl group, or an aryl group; $R^6$ represents a hydrogen atom, an alkyl group, an aryl group, or a hydroxyl group; $R^7$ represents an alkyl group or an aryl group; and Z represents the non-metallic atoms necessary to complete a 5-membered ring or a 6-membered ring, wherein said organic substrate material is a photographically useful dye or fluorescent whitening agent having an absorption maximum at about 300 nm to about 800 nm and wherein said dye is an anthraquinone dye, a quinoneimine dye, an azo dye, a methine dye, a polymethine dye, an indoamine dye, an indophenol dye, or a formazan dye, said at least one compound of formulae I to IV not adversely affecting color hue or color purity of the photographically useful dye or fluorescent whitening agent.

2. The method of claim 1, wherein at least one of said complexes exists in a medium containing the dye or fluorescent whitening agent.

3. The element of claim 2 wherein said at least one organic substrate material is said dye.

4. The element of claim 2 wherein said dye is a photographic dye image formed from a dye-forming coupler, a DDR coupler, a DRR compound, a dye developer, or a silver dye bleaching process.

5. The element of claim 4 wherein said dye-forming coupler is a benzoylacetanilide or an α-pivalylacetanilide yellow dye-forming coupler, a 5-pyrazolone, indazolone, pyrazolinobenzimidazole, pyrazolo-s-triazole, or cyanoacetylcumarone magenta dye-forming coupler; or a phenol or naphthol cyan dye-forming couplers.

6. The element of claim 1 wherein said complex is represented by the formula I and $R^5$ is hydrogen and $R^6$ is hydrogen or hydroxy.

7. The element of claim 6 wherein at least one of $R^1$, $R^2$, $R^3$ and $R^4$ in formula I is an alkyl group bonded directly or through an oxygen atom to the carbon atom of the said benzene ring.

8. The element of claim 6 wherein the sum of the carbon atoms in $R^1$, $R^2$, $R^3$, $R^4$ and $R^7$ in general formula I is at least 4.

9. The element of claim 1 wherein said complex is represented by the formula IIa.

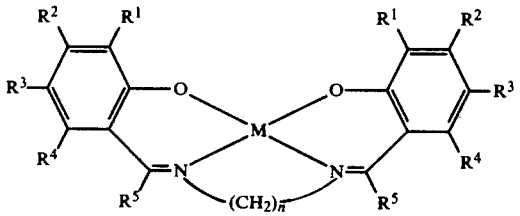

IIa wherein M represents Cu, Co, Ni, Pd, or Pt; $R^1$, $R^2$, $R^3$ and $R^4$ each represents a hydrogen atom, a halogen atom, a cyano group or an alkyl group, an aryl group, a cycloalkyl group, or a heterocyclic group bonded directly or through a divalent connecting group to the carbon atom of a benzene ring; or $R^1$ and $R^2$; $R^2$ and $R^3$; or $R^3$ and $R^4$ combine to represent the non-metallic atoms necessary to complete a 6-membered ring; $R^5$ represents a hydrogen atom, an alkyl group, or an aryl group; and n represents 2 or 3.

10. The element of claim 9 wherein at least one of $R^1$, $R^2$, $R^3$ and $R^4$ in the formula IIa is an alkyl group bonded directly or through an oxygen atom to the carbon atom of the said benzene ring.

11. The element of claim 9 wherein the sum of the carbon atoms in $R^1$, $R^2$, $R^3$, $R^4$ and $R^5$ in formula (IIa) is at least 4.

12. The element of claim 1 wherein said complex is represented by the formula III where $R^6$ is hydrogen or hydroxy.

13. The element of claim 1 wherein said complex is represented by the formula IV and Z is $—CH_2CH_2—$ or $—CH_2CH_2CH—$.

14. The element of claim 1, wherein Z is represented by the following formulae (a), (b), (c), (d) or (e):

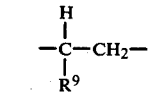

(a)

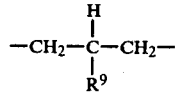

(b)

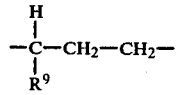

(c)

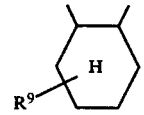

(d)

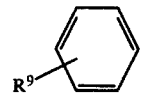

(e)

wherein $R^9$ represents a hydrogen atom or an alkyl group.

15. A color photographic material comprising at least one exposed and developed silver halide emulsion and a mordant layer which contains a photographic dye image, wherein at least one layer containing a photographic dye image or an adjacent layer contains a compound of the formulae (I), (II), (III) or (IV) in an amount which stabilizes the photographic dye image to light;

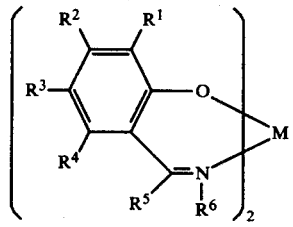

I

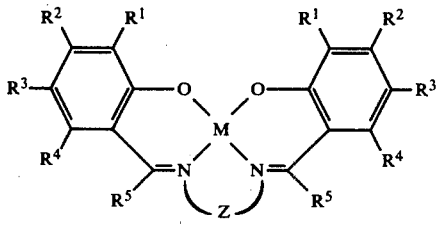

II

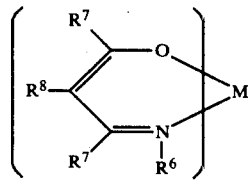

III

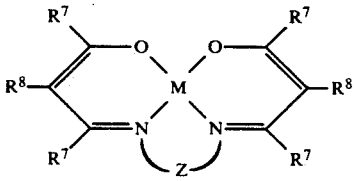

IV wherein M represents Cu, Co, Ni, Pd, or Pt; $R^1$, $R^2$, $R^3$, or $R^4$ each represents a hydrogen atom, a halogen atom, a cyano group or an alkyl group, an aryl group, a cycloalkyl group, or a heterocyclic group, each of which can be bonded directly or through a divalent connecting group to the carbon atom of a benzene ring, or $R^1$ and $R^2$; $R^2$ and $R^3$; or $R^3$ and $R^4$ combine to represent the non-metallic atoms necessary to complete a 6-membered ring; $R^5$ and $R^8$ each represents a hydrogen atom, an alkyl group, or an aryl group; $R^6$ represents a hydrogen atom, an alkyl group, an aryl group, or a hydroxyl group, $R^7$ represents an alkyl group or an aryl group; and Z represents the non metallic atoms necessary to complete a 5-membered ring or a 6-membered ring, wherein said photographic dye image comprises a dye having an absorption maximum at about 300 nm to about 800 nm and wherein said dye is an anthraquinone dye, a quinoneimine dye, an azo dye, a methine dye, a polymethine dye, an indoamine dye, an indophenol dye, or a formazan dye, said compound of the formulae (I) to (IV) not adversely affecting the color hue or color purity of the photographic dye image.

16. The color photographic material of claim 15, wherein said dye image is formed from a dye-forming coupler, a DDR coupler, a DRR compound, a dye developer or a silver dye bleaching process.

17. The color photographic material of claim 15, wherein said complex is represented by the formula I where $R^5$ is hydrogen and $R^6$ is hydrogen or hydroxy.

18. The color photographic material of claim 17, wherein at least one of $R^1$, $R^2$, $R^3$ and $R^4$ in the formula (I) is an alkyl group bonded directly or through an oxygen atom to the carbon atom of the said benzene ring.

19. The color photographic material of claim 18, wherein the sum of the carbon atoms in $R^1$, $R^2$, $R^3$, $R^4$ and $R^7$ in formula (I) is at least 4.

20. The color photographic material of claim 15, wherein said complex is represented by the formula (IIa)

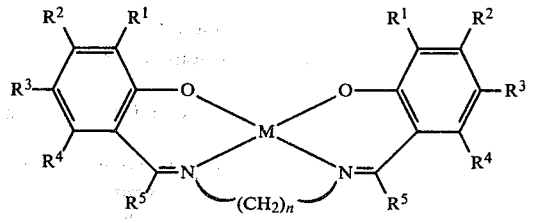

wherein M represents Cu, Co, Ni, Pd, or Pt; $R^1$, $R^2$, $R^3$ and $R^4$ each represents a hydrogen atom, a halogen atom, a cyano group or an alkyl group, an aryl group, a cycloalkyl group, or a heterocyclic group bonded directly or through a divalent connecting group to the carbon atom of a benzene ring; or $R^1$ and $R^2$; $R^2$ and $R^3$; or $R^3$ and $R^4$ combine to represent the non-metallic atoms to complete a 6-membered ring; $R^5$ represents a hydrogen atom, an alkyl group, or an aryl group; and n represents 2 or 3.

21. The color photographic material of claim 20, wherein at least one of $R^1$, $R^2$, $R^3$ and $R^4$ in the formula (IIa) is an alkyl group bonded directly or through an oxygen atom to the carbon atom of the said benzene ring.

22. The color photographic material of claim 21, wherein the sum of the carbon atoms in $R^1$, $R^2$, $R^3$, $R^4$ and $R^5$ in formula (IIa) is at least 4.

23. The color photographic material of claim 15, wherein said complex is represented by the formulae (III) and $R^6$ is hydrogen or hydroxy.

24. The color photographic material of claim 15, wherein said complex is represented by the formula (IV) where Z is $—CH_2CH_2—$ or $—CH_2CH_2CH_2—$.

25. The color photographic material of claim 15, wherein said dye is formed from a benzoylacetanilide or an α-pivalylacetanilide yellow dye forming coupler, a 5-pyrazolone, indazolone, pyrazolinobenzimidazole, pyrazolo-s-triazole, or cyanoacetylcumarone magenta dye-forming coupler, or a phenol or naphthol cyan dye-forming coupler.

26. The color photographic material of claim 15, wherein said material is a diffusion transfer color photographic material comprising a photosensitive element and an image-receiving element wherein said image-receiving element has therein a mordanting layer containing said complex.

27. The element of claim 1 further comprising at least one photographic silver halide emulsion layer.

* * * * *